US010384893B2

(12) United States Patent
Hasegawa

(10) Patent No.: US 10,384,893 B2
(45) Date of Patent: Aug. 20, 2019

(54) SHEET CONVEYING APPARATUS, IMAGE READING APPARATUS, AND IMAGE FORMING APPARATUS

(71) Applicant: CANON FINETECH NISCA INC., Misato-shi, Saitama (JP)

(72) Inventor: Bungo Hasegawa, Moriya (JP)

(73) Assignee: Canon Finetech Nisca Inc., Misato-shi (JP)

( * ) Notice: Subject to any disclaimer, the term of this patent is extended or adjusted under 35 U.S.C. 154(b) by 0 days.

(21) Appl. No.: 15/921,832

(22) Filed: Mar. 15, 2018

(65) Prior Publication Data

US 2018/0273319 A1 Sep. 27, 2018

(30) Foreign Application Priority Data

Mar. 22, 2017 (JP) ..... 2017-056177
Feb. 9, 2018 (JP) ..... 2018-022280

(51) Int. Cl.
*B65H 5/06* (2006.01)
*B65H 7/08* (2006.01)
*B65H 9/00* (2006.01)

(52) U.S. Cl.
CPC ..... *B65H 5/06* (2013.01); *B65H 7/08* (2013.01); *B65H 9/002* (2013.01); *B65H 2511/514* (2013.01); *B65H 2513/104* (2013.01); *B65H 2513/53* (2013.01); *B65H 2553/82* (2013.01);
(Continued)

(58) Field of Classification Search
CPC ..... B65H 3/06; B65H 3/0669; B65H 3/0676; B65H 5/06; B65H 5/062; B65H 7/02; B65H 7/08; B65H 7/18; B65H 2513/10; B65H 2513/104; B65H 2513/108; B65H 2513/53
See application file for complete search history.

(56) References Cited

U.S. PATENT DOCUMENTS 4,430,606 A * 2/1984 Otsuki ..... B65H 5/062 318/601
5,156,391 A 10/1992 Roller
9,828,200 B2 * 11/2017 Kuwata ..... B65H 5/062
(Continued)

FOREIGN PATENT DOCUMENTS

JP H05-201587 A 8/1993
JP H09-24436 A 1/1997
(Continued)

*Primary Examiner* — David H Bollinger
(74) *Attorney, Agent, or Firm* — Venable LLP

(57) ABSTRACT

A sheet conveying apparatus includes a controller to set conveyance speeds of first, second, and third conveyance rotary members. The controller sets the conveyance speed of a sheet by the second conveyance rotary member to a first conveyance speed, which is the same as a conveyance speed of the sheet by the first conveyance rotary member, and a second conveyance speed which is different from the first conveyance speed. When the controller sets the conveyance speed of the sheet by the first conveyance rotary member to the first conveyance speed and sets the conveyance speed of the sheet by the second conveyance rotary member to the second conveyance speed, the controller sets the conveyance speed of the sheet by the third conveyance rotary member to a third conveyance speed which is a speed between the first conveyance speed and the second conveyance speed.

12 Claims, 13 Drawing Sheets

(52) U.S. Cl.
CPC .. *B65H 2701/1311* (2013.01); *B65H 2801/06* (2013.01); *B65H 2801/39* (2013.01)

(56) References Cited

U.S. PATENT DOCUMENTS

| | | | | |
|---|---|---|---|---|
| 2014/0232055 | A1* | 8/2014 | Yamagata | B65H 7/02 271/3.18 |
| 2017/0050812 | A1* | 2/2017 | Mukai | B65H 3/46 |

FOREIGN PATENT DOCUMENTS

| | | | |
|---|---|---|---|
| JP | 2003-312900 | A | 11/2003 |
| JP | 2010-042903 | A | 2/2010 |

* cited by examiner

SHEET CONVEYING APPARATUS, IMAGE READING APPARATUS, AND IMAGE FORMING APPARATUS

BACKGROUND OF THE INVENTION

Field of the Invention

The present invention relates to a sheet conveying apparatus configured to convey a sheet, and to an image reading apparatus and an image forming apparatus which include such a sheet conveying apparatus.

Description of the Related Art

As a sheet conveying apparatus, there has been proposed, as disclosed in Japanese Patent Application Laid-Open No. H05-201587, an apparatus which corrects skew feed of a sheet by setting a conveyance speed difference to a pair of conveyance rollers arranged apart from each other by a predetermined interval in a width direction of a sheet orthogonal to a conveyance direction of a sheet.

However, when the conveyance speed difference is set to the pair of conveyance rollers as disclosed in Japanese Patent Application Laid-Open No. H05-201587, there is a fear in that wrinkles are formed in a sheet between the pair of conveyance rollers and a roller arranged upstream of the pair of conveyance rollers.

SUMMARY OF THE INVENTION

The present invention provides a sheet conveying apparatus which is less liable to cause formation of wrinkles in a sheet during sheet conveyance.

According to one embodiment of the present invention, a sheet conveying apparatus, comprises:

a separation-conveyance portion configured to separate and convey a sheet;

a first conveyance rotary member, which is provided downstream of the separation-conveyance portion in a sheet conveyance direction and is configured to further convey the sheet at a predetermined conveyance speed in contact with the sheet being conveyed by the separation-conveyance portion;

a second conveyance rotary member, which is provided downstream of the separation-conveyance portion in the sheet conveyance direction, is arranged apart from the first conveyance rotary member by a predetermined interval in a width direction orthogonal to the sheet conveyance direction, and is configured to convey the sheet being conveyed by the separation-conveyance portion in cooperation with the first conveyance rotary member; and a third conveyance rotary member, which is arranged at a position between a position at a most downstream end of the separation-conveyance portion and a position at a most downstream end of the first conveyance rotary member or the second conveyance rotary member in the sheet conveyance direction and is configured to convey the sheet being conveyed by the separation-conveyance portion, wherein a conveyance speed of the sheet by the second conveyance rotary member is changeable to a first conveyance speed which is the same as a conveyance speed of the sheet by the first conveyance rotary member and a second conveyance speed which is different from the first conveyance speed, and wherein, when the conveyance speed of the sheet by the first conveyance rotary member is set to the first conveyance speed and the conveyance speed of the sheet by the second conveyance rotary member is set to the second conveyance speed, a conveyance speed of the sheet by the third conveyance rotary member is set to a third conveyance speed which is a speed between the first conveyance speed and the second conveyance speed.

Further features of the present invention will become apparent from the following description of exemplary embodiments with reference to the attached drawings.

DESCRIPTION OF THE EMBODIMENTS

Now, with reference to the attached drawings, embodiments of the present invention will be described in detail.

First Embodiment

A first embodiment of the present invention will be described with reference to FIG. 1 to FIG. 7. In the first embodiment, a description will be provided of an embodiment of a sheet conveying apparatus provided in an image reading apparatus mounted to an image forming apparatus.

(Image Reading Apparatus)

Figure 1:
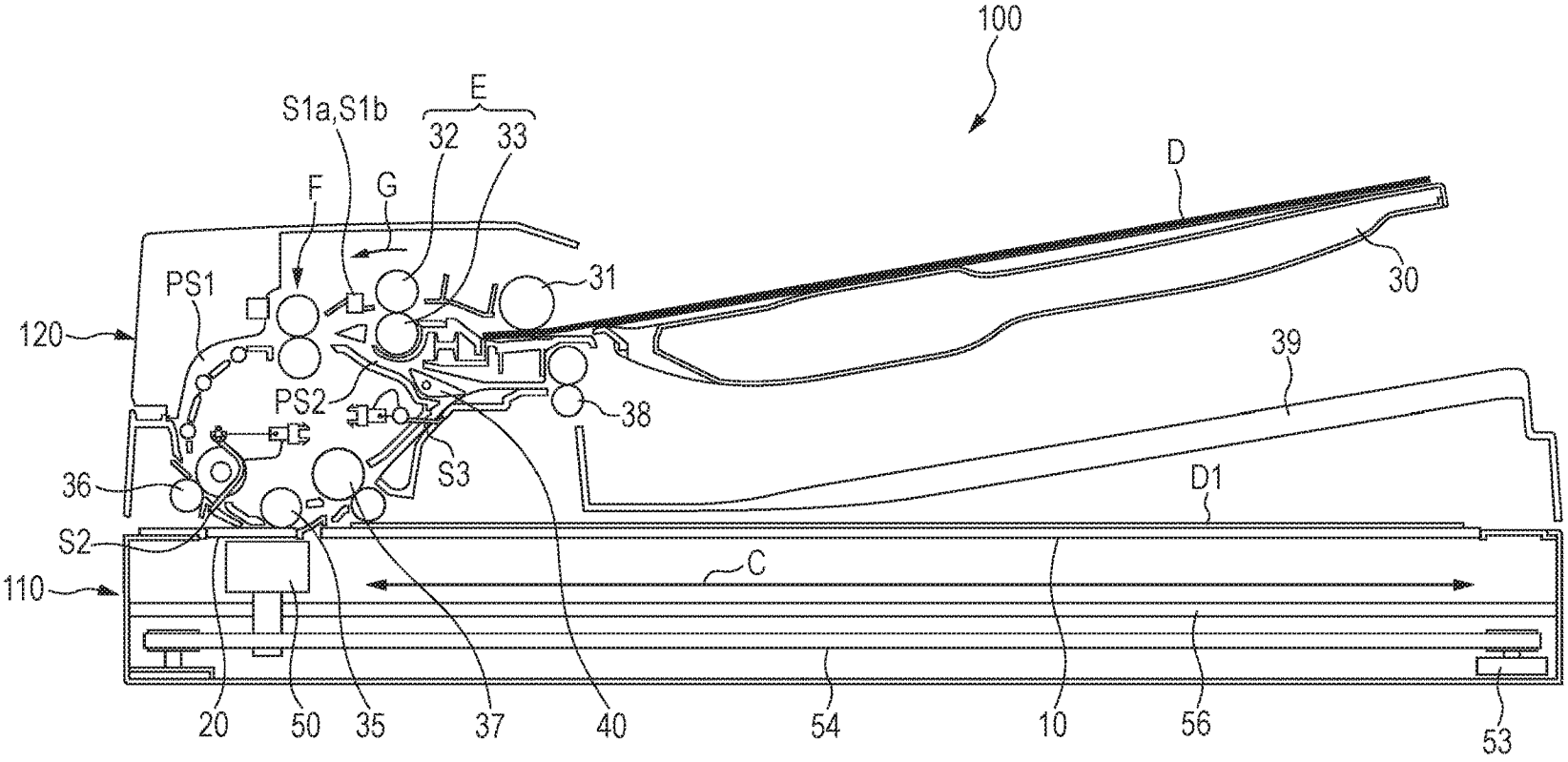
FIG. 1 is an explanatory view for illustrating a configuration of an image reading apparatus according to a first embodiment of the present invention.

As illustrated in FIG. 1, an image reading apparatus 100 includes an image reading unit 110 and an original conveying apparatus 120. The image reading unit 110 is configured to read an image of an original D. An original conveying apparatus 120 is capable of conveying originals D, which are placed on an original placement unit 30, one after another.

The original conveying apparatus 120 is turnable with respect to the image reading unit 110 by an opening and closing support mechanism (not shown) using a hinge (not shown), and is capable of opening and closing an upper side of the image reading unit 110. On the upper side of the image reading unit 110, there are arranged an original glass plate 10 and a flow reading glass plate 20. In the image reading unit 110, there is arranged a read-scanning unit 50.

The read-scanning unit 50 radiates light to a lower surface of the original D from a light source (not shown) arranged in a main scanning direction and allows reflected light to be projected on an image pickup element (not shown), to thereby read an image. The read-scanning unit 50 is fixed to a drive belt 54, and a drive force of a drive motor 53 is transmitted through the drive belt 54 so that the read-scanning unit 50 moves along a guide shaft 56 in an arrow C direction. For example, a stepping motor or a DC motor is used as the drive motor 53. A moving direction (arrow C direction) of the read-scanning unit 50 is referred to as a sub-scanning direction, and a direction orthogonal to the sub-scanning direction is referred to as a main scanning direction.

As modes of reading an original, the image reading apparatus 100 is capable of performing reading in a fixed-reading mode and a flow-reading mode, which are to be selected by a user. In the fixed-reading mode, the image reading unit 110 reads an original D1 placed on the original glass plate 10. A user opens the original conveying apparatus 120, places the original D1 on the original glass plate 10, closes the original conveying apparatus 120, and operates a control panel (135 in FIG. 6) to input a command to start reading. At this time, the original D1 is pressed by the original conveying apparatus 120 and fixed on the original glass plate 10. When the command to start reading is input, the read-scanning unit 50 reads an image of a lower surface of the original D1 placed on the original glass plate 10 while moving in the arrow C direction below the original glass plate 10.

In the flow-reading mode, the image reading unit 110 reads the original D conveyed by the original conveying apparatus 120 to the flow reading glass plate 20. A user places the original D on the original placement unit 30 and operates the control panel (135 in FIG. 6) to input the command to start reading. The original conveying apparatus 120 conveys the original D from the original placement unit one after another to a conveyance passage in the original conveying apparatus 120, allows the original D to pass above the flow reading glass plate 20, and delivers the original D to an original delivery portion 39. At this time, in a state of being stopped below the flow reading glass plate 20, the read-scanning unit 50 continuously reads an image of a lower surface of the original D moving above the flow reading glass plate 20.

(Original Conveying Apparatus)

As illustrated in FIG. 1, the image reading unit 110 being an example of an image reading device reads an image of the original (sheet) D having been subjected to skew feed correction performed by the original conveying apparatus 120 being an example of a sheet conveying apparatus. The original conveying apparatus 120 conveys the original D placed on the original placement unit 30 one after another by a pickup roller 31 and allows the original D to pass above the flow reading glass plate 20 at a constant speed. The pickup roller 31 rotates while being held in abutment against an upper surface of the original D placed on the original placement unit 30 to bring the original D to a separation portion E being a separation-conveyance portion.

The separation portion E includes a conveyance roller (conveyance member) 32, which rotates so as to convey the original in an original conveyance direction (sheet conveyance direction) G, and a retard roller (separation member) 33, which forms a separation nip with the conveyance roller 32, thereby being capable of separating and conveying a sheet. The retard roller 33 is driven in a direction of conveying the original in a direction opposite to the original conveyance direction G of the conveyance roller 32, and is capable of being driven by the conveyance roller 32. At such separation portion E, while the conveyance roller 32 conveys an uppermost original D to a skew feed correction portion F provided downstream of the separation portion E in the original conveyance direction G, the retard roller 33 pushes back a multi-fed original, which is fed together with the original D, to the original placement unit 30. Further, when one original is conveyed to the separation portion E, the retard roller 33 is driven by the conveyance roller 32 to rotate, thereby conveying the original D to the skew feed correction portion F.

The skew feed correction portion F corrects skew feed of the original D conveyed from the separation portion E, feeds the original D to a conveyance path PS1, and gives the original D to a read roller 36. The read roller 36 is arranged upstream of a platen roller 35. The read roller 36 conveys the original D having been subjected to the skew feed correction by the skew feed correction portion F to the flow reading glass plate 20, and gives the original D to the read roller 37. A read sensor S2 detects a reading start timing for the original D. The read-scanning unit 50 reads an image of the original D at the reading timing detected by the read sensor S2.

The platen roller 35 regulates a rise-up amount of the original D from the upper surface of the flow reading glass plate 20 to retain the lower surface of the original D at a focal point position of the read-scanning unit 50. An image of the original D is read by the read-scanning unit 50 while the original D is conveyed under a state in which the rise-up amount of the original D from the upper surface of the flow reading glass plate 20 is regulated by the platen roller 35 rotating at a predetermined rotation speed.

The read rollers 36 and 37 rotate at a predetermined rotation speed to allow the original D to pass above the flow reading glass plate 20 and move at a constant speed. The read roller 37 is arranged downstream of the platen roller 35, and gives the original D, which has passed above the upper surface of the flow reading glass plate 20, to a delivery roller 38.

When only an image on one side of the original D is to be read, the original D whose image has been read is delivered by the delivery roller 38 to the original delivery portion 39 and stacked thereon. When images on both sides of the original D are to be read, the original D whose image on a first side is read is brought by the delivery roller 38 to a position of protruding toward the original delivery portion 39, and the delivery roller 38 then stops and rotate in a reverse direction so that a leading edge and a trailing edge of the original D is switched to be brought back into the apparatus. At this time, a flapper 40 is switched to a reverse conveyance passage PS2. As a result, the original D having been brought back is fed again to the conveyance path PS1 under a state in which the front and back sides of the original D are reversed as compared to the time of reading the first side. The original D is conveyed above the flow reading glass plate 20 by the read rollers 36 and 37, and an image on a second side of the original D is read by the read-scanning unit 50. After that, the original D is allowed to pass through the reverse conveyance path PS2 and the conveyance path PS1 to set up the page order, and then is delivered by the delivery roller 38 to the original delivery portion 39 and stacked thereon.

(Skew Feed Correction Portion)

Figure 2:
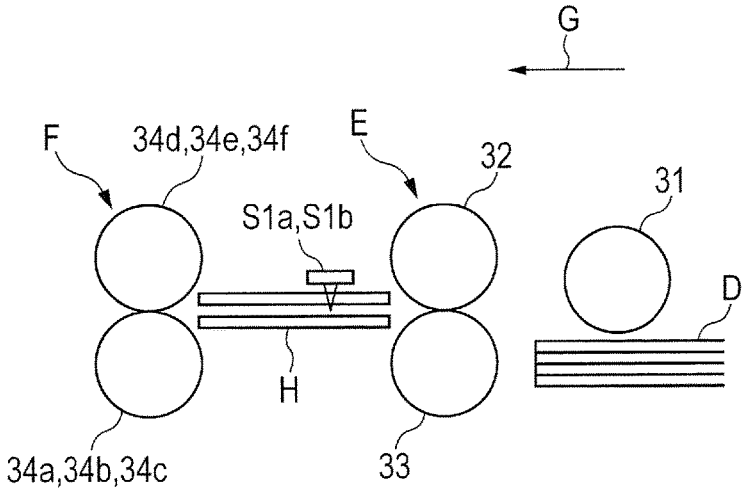
FIG. 2 is an enlarged view for illustrating a separation portion and a skew feed correction portion.
Figure 3:
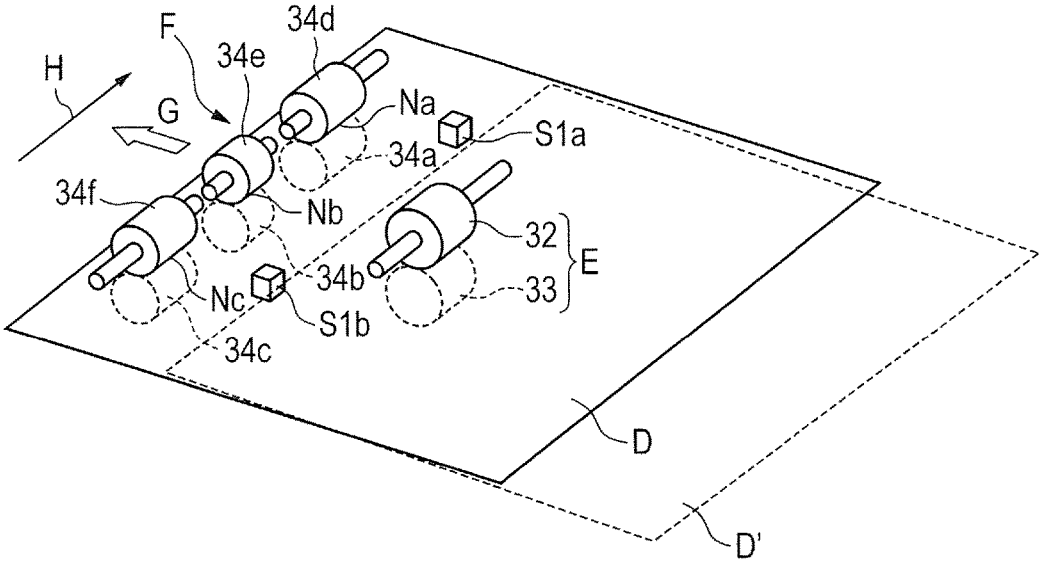
FIG. 3 is an explanatory view for illustrating arrangement of rollers of the separation portion and the skew feed correction portion.

As illustrated in FIG. 1, in the original conveying apparatus 120, the skew feed correction portion F is provided downstream of the separation portion E in order to correct skew feed of the original D before the original D having been separated by the separation portion E arrives at the read roller 36. In the drawings to be referred in the following description, members which are not required to be illustrated are omitted for ease of understanding of a positional relationship of members. FIG. 2 is an enlarged view for illustrating the separation portion E and the skew feed correction portion F. FIG. 3 is an explanatory view for illustrating arrangement of rollers of the separation portion E and the skew feed correction portion F.

As illustrated in FIG. 2, the separation portion E is arranged downstream of the pickup roller 31 apart by a predetermined distance in the original conveyance direction G. The skew feed correction portion F is arranged downstream of the separation portion E apart by a predetermined distance in the original conveyance direction G. Skew feed detection sensors S1*a* and S1*b* are arranged between the separation portion E and the skew feed correction portion F. The pickup roller 31 rotates while being held in abutment against the original D to feed the original D to the separation portion E.

As illustrated in FIG. 3, the separation portion E is arranged downstream of the skew feed correction portion F in the original conveyance direction G, and is capable of separating and conveying the original D one after another from a plurality of stacked originals. The skew feed correction portion F includes a correction roller 34*a* being a first conveyance rotary member, a correction roller 34*c* being a second conveyance rotary member, and a correction roller 34*b* being a third conveyance rotary member, which are capable of conveying the original (sheet) D. The correction roller 34*c* is arranged apart by a predetermined interval from the correction roller 34*a* in a width direction H orthogonal to the original conveyance direction (sheet conveyance direction) G of the correction roller 34*a*. The correction roller 34*b*, as described later in detail, is arranged between the correction roller 34*a* and the correction roller 34*c* in the width direction H orthogonal to the original conveyance direction G. The correction rollers 34*a*, 34*b*, and 34*c* are held in abutment against rollers 34*d*, 34*e*, and 34*f*, respectively, to form nips Na, Nb, and Nc capable of nipping the original D. The skew feed detection sensors S1*a* and S1*b* being sheet detectors are arranged apart from each other by a predetermined interval on the same line parallel to the width direction H orthogonal to the original conveyance direction G, and are capable of detecting an original to be conveyed. Through measurement of a difference in timings at which the skew feed detection sensors S1*a* and S1*b* detect a leading edge of an original D' indicated by broken lines, a skew feed amount of the original D' is determined.

The correction roller 34*c* is capable of conveying the original D in cooperation with the correction roller 34*a*, and a peripheral speed (hereinafter referred to as "conveyance speed") of the correction roller 34*c* can be changed to a conveyance speed which is different from a conveyance speed of the correction roller 34*a*. With this configuration, in the skew feed correction portion F, different conveyance speeds are set to the correction rollers 34*a* and 34*c* based on the skew feed amount of the original D' determined in accordance with detection results of the skew feed detection sensors S1*a* and S1*b*. With this configuration, the original D' is rotated within a conveyance plane so that, as illustrated with the original D indicated by solid lines, the skew feed of the original D' is corrected. After the skew feed of the original D' is corrected, in the skew feed correction portion F, the same conveyance speed is set to the correction rollers 34*a* and 34*c*, and the original having been subjected to skew feed correction is conveyed as it is.

(Comparative Example)

Figure 4A:
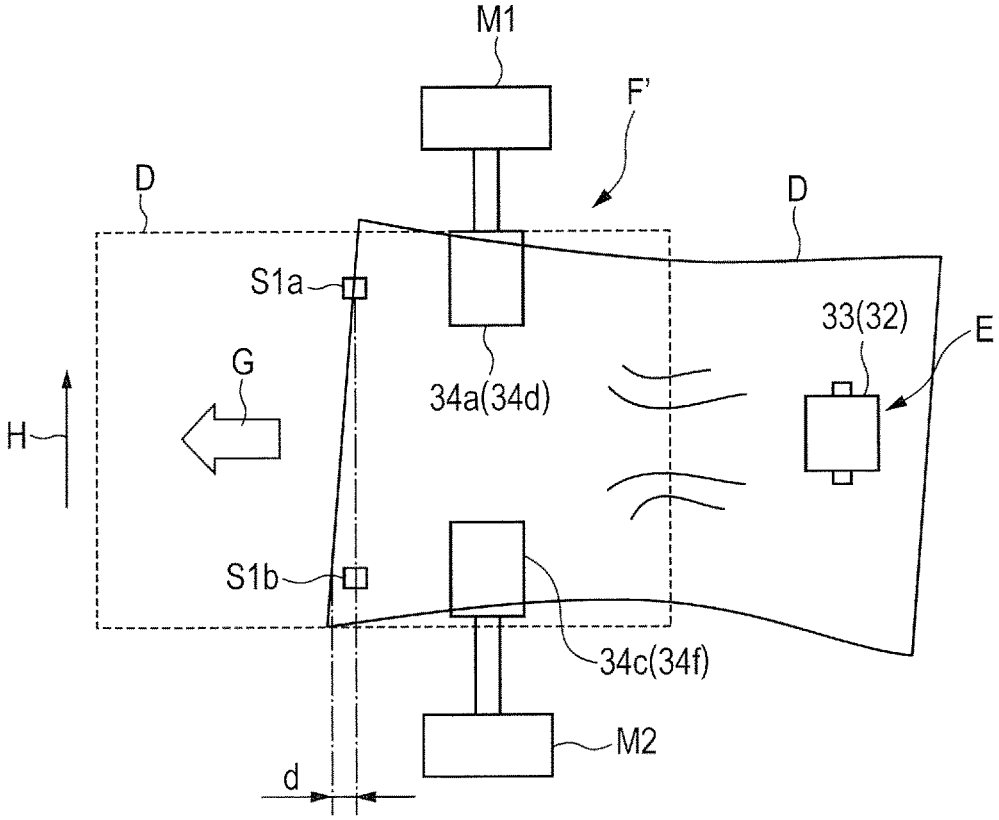
FIG. 4A is an explanatory view for illustrating a skew feed correction portion in a comparative example.
Figure 4B:
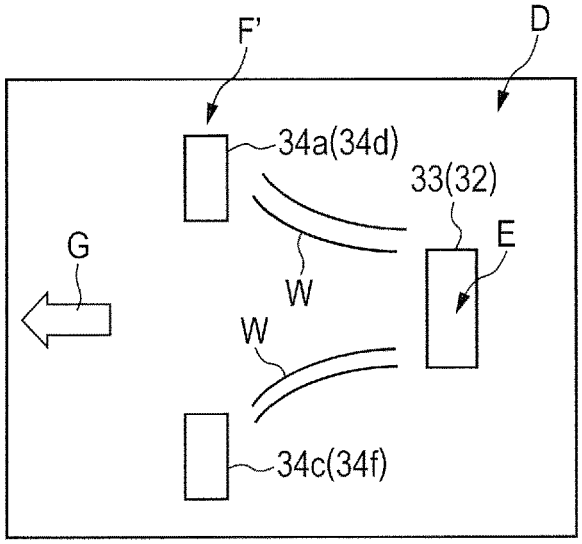
FIG. 4B is a schematic view for illustrating warpage of a sheet in the comparative example.

FIG. 4A and FIG. 4B are explanatory views for illustrating a skew feed correction portion F' in a comparative example. As illustrated in FIG. 4A, also for the skew feed correction portion F' in the comparative example, a conveyance speed difference is set to the pair of correction rollers 34*a* and 34*c*, which are arranged apart from each other by a predetermined distance in the width direction of the original D, to rotate the original D within the conveyance plane, to thereby correct the skew feed of the original D. However, the case of the comparative example is different from the above-mentioned embodiment in that a correction roller is not arranged between the correction rollers 34*a* and 34*c*.

Therefore, in the case of the configuration including the skew feed correction portion F' in the comparative example, there is a fear in that wrinkles are formed in the original D to be conveyed. For example, the separation portion E is arranged upstream of the correction rollers 34*a* and 34*c* in the original conveyance direction G, and conveyance resistance such as friction resistance or pull-out resistance by the separation portion E acts on a center portion of the original D in the width direction H. Thus, both sides of the original D are conveyed by the correction rollers 34*a* and 34*c* under a state in which the center portion of the original D is pulled by the separation portion E, with the result that warpage as illustrated in FIG. 4A is liable to occur in the original D. When the warpage occurs in the original D, there is a fear in that wrinkles are formed due to skew feed of the original D or due to nipping of the warpage by the rollers.

A more specific description will be provided. For example, when a plurality of originals are conveyed in a superposed state (multi-fed), in the separation portion E, while the conveyance roller 32 rotates in a forward direction to feed the uppermost original D to the skew feed correction portion F, the retard roller 33 rotates in a reverse direction to push back the multi-fed original to an upstream side. Then, at the moment at which the multi-fed original is pushed out toward the upstream side, the retard roller 33 having been rotating in the reverse direction applies a significant amount of friction to the lower surface of the uppermost original D to pull the original D toward the upstream side. As a result, the original D is pulled between the correction rollers 34*a* and 34*c* arranged apart in the width direction and the separation portion E arranged on the upstream side, and the original D is twisted thereby. Accordingly, as illustrated in FIG. 4B, the warpage W occurs in the original D between the correction roller 34*a* and 34*c* and the separation portion E. That is, when the skew feed correction portion F' is arranged downstream of the separation portion E, the warpage W occurs in the original D due to the conveyance resistance which is generated when the skew feed correction portion F' pulls out the original D passing through the separation portion E. Wrinkles corresponding to the warpage W may be formed in the original D which is conveyed to the skew feed correction portion F' in the above-mentioned state. Further, the phenomenon described above may occur also in a case in which, for example, a separation pad having a large friction force with respect to a sheet is used in place of the retard roller 33.

Thus, with the configuration disclosed in Japanese Patent Application Laid-Open No. H05-201587 mentioned above, between the separation portion and the rollers configured to correct the skew feed, a conveyance roller configured to convey a sheet is provided at a position substantially the same as the rollers configured to correct the skew feed in the width direction orthogonal to the original conveyance direction. Therefore, the conveyance passage for conveying the sheet is extended, and downsizing of the apparatus is hindered.

(Skew Feed Correction Portion in First Embodiment)

Figure 5:
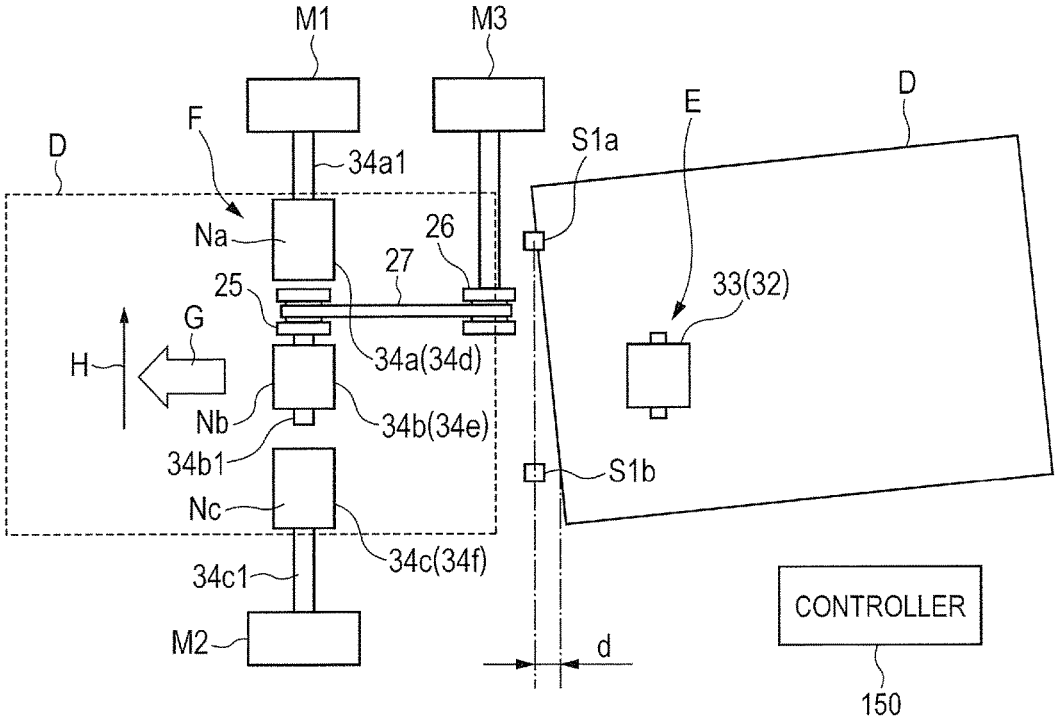
FIG. 5 is an explanatory view for illustrating the skew feed correction portion in the first embodiment.

Therefore, in the first embodiment, as illustrated in FIG. 3, the correction roller 34*b* is arranged at a position which is located between the correction rollers 34*a* and 34*c* in the original conveyance direction G as seen in the width direction H orthogonal to the original conveyance direction G and overlaps with a position of the retard roller 33 in the width direction H as seen in the original conveyance direction G. With this configuration, the warpage W of the original D due to the conveyance resistance of the separation portion E is alleviated, thereby suppressing formation of wrinkles. It is preferred that the position of the correction roller 34*b* be located, as seen in the width direction H, between a position of the retard roller 33 at the most downstream end in the original conveyance direction G and a position of a most downstream end of the correction rollers 34*a* and 34*c* in the original conveyance direction G. Further, in addition, it is preferred that the position of the correction roller 34*b* be located at a position at which, as seen in the original conveyance direction G, at least a part of the correction roller 34*b* overlaps with the position of the retard roller 33 in the width direction H. With reference to FIG. 5, a configuration of the skew feed correction portion F in the first embodiment will be described in detail.

As illustrated in FIG. 5, for skew feed correction, the correction roller 34*a* being an example of the first conveyance rotary member and the correction roller 34*c* being an example of the second conveyance rotary member are capable of conveying the original D with a conveyance speed difference at positions apart from each other in the width direction H orthogonal to the original conveyance direction G. In the first embodiment, the correction roller 34*b* is arranged between the correction roller 34*a* and the correction roller 34*c*. The separation portion E is arranged upstream of the correction roller 34*b* in the original conveyance direction G. In the first embodiment, the correction roller 34*b* is arranged at a position of overlapping with the retard roller 33 of the separation portion E as seen in the original conveyance direction G. That is, the correction roller 34*b* is arranged at a center position between the correction roller 34*a* and the correction roller 34*c* in the width direction H. The separation portion E is arranged upstream of the correction rollers 34*a* and 34*c* in the original conveyance direction G at a position corresponding to a center position between the correction roller 34*a* and the correction roller 34*c* in the width direction H. In other words, the correction roller 34*b* is arranged at the same position as the separation portion E in the width direction H orthogonal to the original conveyance direction G of the original D.

Thus, the correction roller 34*b* conveys the original (sheet) D at an intermediate position between the correction roller 34*a* and the correction roller 34*c* so as to overcome the conveyance resistance generated in the separation portion E. With this action, the correction roller 34*b* pulls the original D toward the downstream side while overcoming the conveyance resistance generated in the separation portion E, thereby alleviating the warpage W which occurs between the correction rollers 34*a* and 34*c* and the separation portion E.

The correction rollers 34*a*, 34*b*, and 34*c* are arranged so that, as illustrated in FIG. 5, respective rotary shafts 34*a*1, 34*b*1, and 34*c*1 of the correction rollers 34*a*, 34*b*, and 34*c* are arranged on the same straight line in the width direction H orthogonal to the original conveyance direction G. In the first embodiment, the correction rollers 34*a*, 34*b*, and 34*c* are driven by stepping motors M1, M3, and M2, respectively, which are driven independently. That is, the skew feed correction portion F in the first embodiment includes the stepping motor M1 being a first drive device, the stepping motor M2 being a second drive device, and the stepping motor M3 being a third drive device. The stepping motor M1 is configured to drive the correction roller 34*a* to rotate. The stepping motor M2 is configured to drive the correction roller 34*c* to rotate. The stepping motor M3 is configured to drive the correction roller 34*b* to rotate.

Further, in the first embodiment, the skew feed detection sensors S1*a* and S1*b* which are capable of detecting a leading edge of the original D to be conveyed are arranged upstream of the correction rollers 34*a*, 34*b*, and 34*c* in the original conveyance direction G. The skew feed detection sensors S1*a* and S1*b* are arranged apart from each other by a predetermined interval in the width direction H so that respective detection positions for detecting the original D are positioned on the same straight line parallel to the width direction H orthogonal to the original conveyance direction G. Therefore, the leading edge of the original D fed by the separation portion E is detected by the skew feed detection sensors S1*a* and S1*b* at timings depending on the skew feed amount of the original D. The skew feed detection sensors S1*a* and S1*b* are each a reflected light sensor configured to detect reflected light of infrared light emitted from a light source (LED) with a photodiode.

Now, it is assumed that, in order to correct the skew feed of the original D to be conveyed, the correction roller 34*a* is set to a first conveyance speed, and the correction roller 34*c* is set to a second conveyance speed different from the first conveyance speed. In this case, the conveyance speed of the correction roller 34*b* is set to a third conveyance speed between the first conveyance speed and the second conveyance speed. That is, through control by a controller 150, the stepping motor M3 drives the correction roller 34*b* so that the correction roller 34*b* conveys the original D at an intermediate conveyance speed between the conveyance speed of the correction roller 34*a* and the conveyance speed of the correction roller 34*c*. For example, a rotation speed of the stepping motor M3 is controlled so that the correction roller 34*b* conveys the original D at a conveyance speed which is an average between the conveyance speed of the correction roller 34*a* and the conveyance speed of the correction roller 34*c*.

The stepping motor M3 drives the correction roller 34*b* without involvement to drive of the correction rollers 34*a* and 34*c*. Therefore, any complicated mechanism such as planetary gears is not required, and hence reduction in number of components of the mechanism and downsizing are achieved. In the first embodiment, the correction roller 34*b* is driven by the stepping motor M3 through intermediation of toothed pulleys 25 and 26 and a toothed belt 27.

Figure 6:
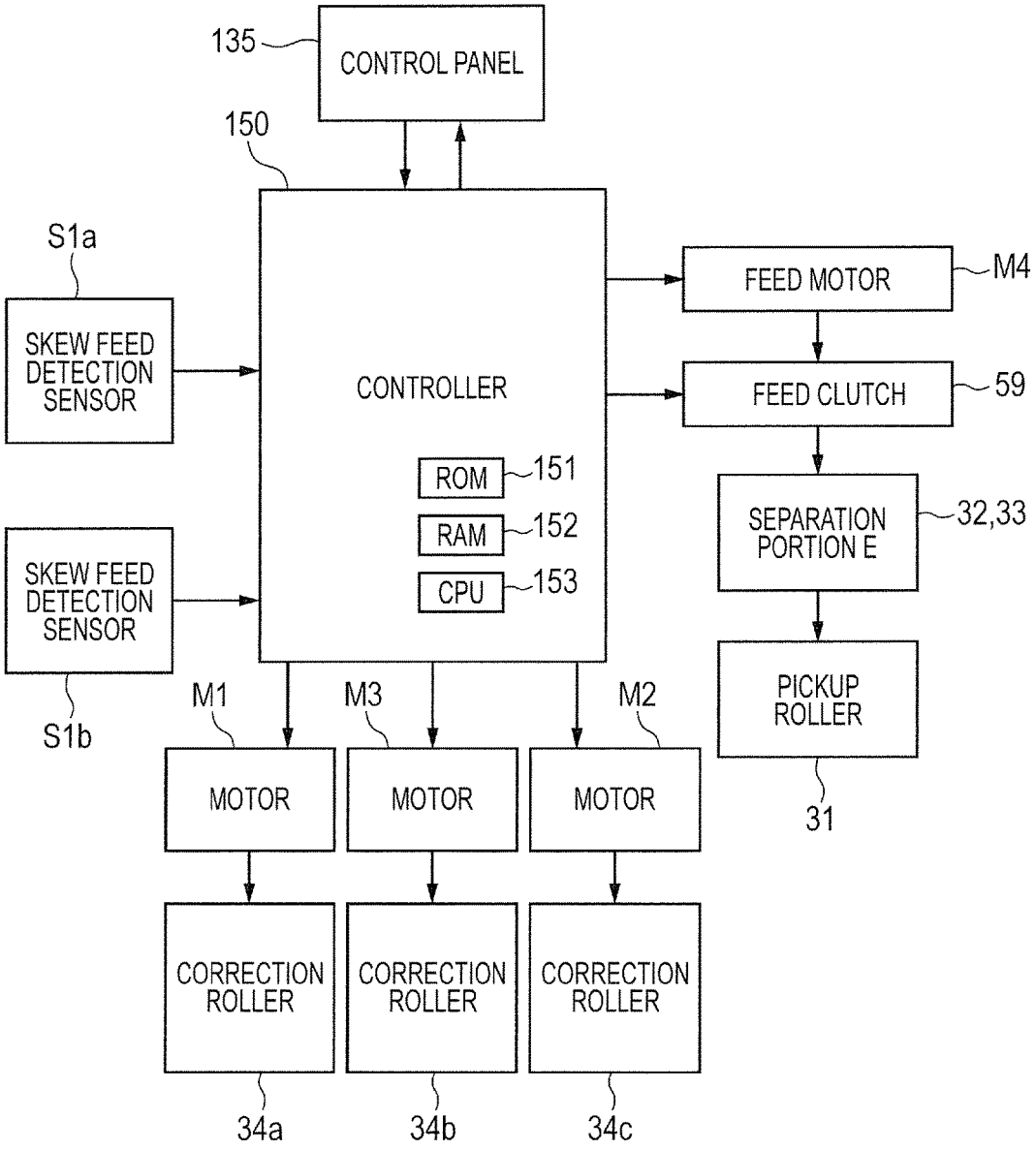
FIG. 6 is a block diagram for illustrating a control system for an original conveying apparatus in the first embodiment.

As illustrated in FIG. 6, the controller 150 includes a ROM 151, a RAM 152, and a CPU 153. The ROM 151 stores, for example, a program corresponding to a control procedure. The CPU 153 is configured to execute control for components while reading the program. The RAM 152 stores work data and input data. The CPU 153 is configured to execute control by referring to data stored in the RAM 152 based on, for example, the above-mentioned program. The control panel 135 is operated by a user to perform various input and setting with respect to the image reading apparatus 100.

A feed motor M4 drives the pickup roller 31 and the separation portion E. The controller 150 engages the feed clutch 59 to transmit drive of the feed motor M4 to the pickup roller 31, and disengages the feed clutch 59 to cut transmission of the drive of the feed motor M4. The controller 150 controls the stepping motors M1, M2, and M3 to drive the correction rollers 34*a*, 34*b*, and 34*c*. The controller 150 sets conveyance speeds of the correction rollers 34*a* and 34*c* based on detection results of the skew feed detection sensors S1*a* and S1*b*.

Specifically, the controller 150 calculates a skew feed amount of the original D based on a difference in timings at which the skew feed detection sensors S1*a* and S1*b* detect the leading edge of the original D. Based on the calculated skew feed amount, the controller 150 controls the stepping motors M1 and M2 to drive the correction rollers 34*a* and 34*c* to rotate, and sets a conveyance speed difference corresponding to the skew feed amount between the correction roller 34*a* and the correction roller 34*c*. Then, the controller 150, while maintaining the conveyance speed difference, drives the correction rollers 34*a* and 34*c* for a time period corresponding to the skew feed amount. With this action, the original D is rotated within the conveyance plane, thereby correcting the skew feed of the original D.

In accordance with detection of the trailing edge of the original D by the skew feed detection sensors S1*a* and S1*b*, the controller 150 determines a feed timing of a next original by the pickup roller 31. Further, the controller 150 performs size determination for the original D in accordance with detection timings for the leading edge and the trailing edge of the original D by the skew feed detection sensors S1*a* and S1*b*.

Next, a specific example of control of the skew feed correction will be described with reference to FIG. 5. As illustrated in FIG. 5, when the original D is conveyed with skew feed, during a time period of from detection of the leading edge of the original D by the skew feed detection sensor S1*a* to detection of the leading edge of the original D by the skew feed detection sensor S1*b*, the original D is conveyed by a distance d [mm]. When the conveyance speed of the original D is X [mm/sec], the time period ΔT [sec] of from detection of the leading edge of the original D by the skew feed detection sensor S1*a* to detection of the leading edge of the original D by the skew feed detection sensor S1*b* satisfies a relationship given by the following expression.

$$\Delta T = d/X$$

The controller 150 calculates the distance d based on a measurement value of the time period ΔT and the known conveyance speed X, and determines the skew feed amount of the original D based on the distance d and the arrangement interval of the skew feed detection sensors S1*a* and S1*b*. Then, based on the skew feed amount, the controller 150 determines a conveyance speed difference between the correction rollers 34*a* and 34*c* for correction of the skew feed. Then, for example, the controller 150 increases the conveyance speed of the correction roller 34*c* to be higher than an initial conveyance speed given before the skew feed correction. In this case, the conveyance speed of the correction roller 34*a* may be maintained at the initial conveyance speed without any change, or the conveyance speed of the correction roller 34*a* may be reduced to be lower than the initial conveyance speed. Further, both the changes in conveyance speeds of the correction roller 34*a* and the correction roller 34*c* may be performed simultaneously.

In any case, the conveyance speed of the correction roller 34*b* at the center is set to a conveyance speed between the conveyance speed of the correction roller 34*a* and the conveyance speed of the correction roller 34*c*. In particular, the conveyance speed of the correction roller 34*b* is set to a median value. When one roller of the correction rollers 34*a* and 34*c* is increased in speed, and another roller is reduced in speed at a rate which is the same as that of the rate of increase in speed of the one roller, the conveyance speed of the correction roller 34*b* remains at the initial conveyance speed.

The initial conveyance speeds of the correction rollers 34*a*, 34*b*, and 34*c* are equal. Further, when the original D involves skew feed in a direction opposite to that illustrated in FIG. 5, only the order of detection of the leading edges of the original at the skew feed detection sensors S1*a* and S1*b* is changed, and the same control is executed.

Figure 7:
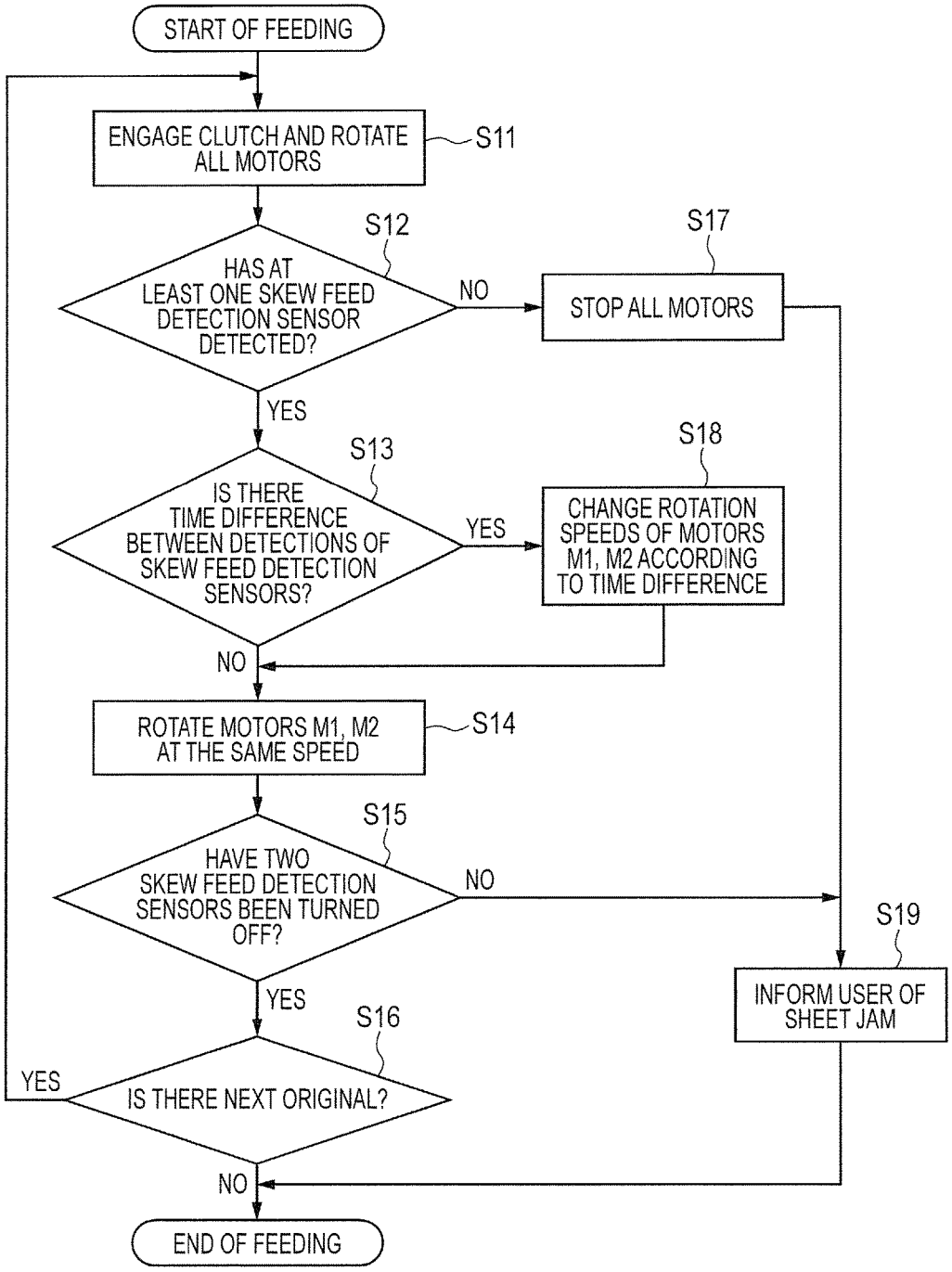
FIG. 7 is a flowchart for illustrating skew feed correction control for the original conveying apparatus in the first embodiment.

With reference to FIG. 6 and FIG. 7, a description will be provided of an example of a flow of control in the first embodiment described above. When a command to start image reading is given, the CPU 153 engages the feed clutch 59 and, at the same time, operates the stepping motors M1, M2, and M3 (Step S11).

At this time, the pickup roller 31, the conveyance roller 32, and the retard roller 33 operate, and the correction rollers 34*a*, 34*b*, and 34*c* rotate at the same speed to wait for the original D. After elapse of a predetermined time period, when none of the skew feed detection sensors S1*a* and S1*b* detects the leading edge of the original D (NO in Step S12), the CPU 153 stops all the motors (Step S17), determines that conveyance abnormality due to jamming of the original D has occurred, and informs a user of the jamming of the original (sheet) (Step S19).

When at least one of the skew feed detection sensors S1*a* and S1*b* detects the leading edge of the original D before elapse of a predetermined time period (YES in Step S12), the CPU 153 determines whether or not there is a time difference between detections by the skew feed detection sensors S1*a* and S1*b* (Step S13). When there is the time difference (YES in Step S13), the CPU 153 calculates a skew feed amount of the original D based on the detection results, and changes rotation speeds of the stepping motors M1 and M2 in accordance with the skew feed amount (Step S18). At this time, the changes in rotation speed of the stepping motors M1 and M2 are maintained for a time period corresponding to the skew feed amount (time difference in Step S13). After elapse of this time period, the rotation speeds of the stepping motors M1 and M2 are set back to speeds which cause the correction rollers 34*a* and 34*c* to rotate at the same speed (Step S14).

When there is no time difference between the detections by the skew feed detection sensors S1*a* and S1*b* in Step S13, that is, when the skew feed detection sensors S1*a* and S1*b* detect the leading edge of the original D at the same time (NO in Step S13), the CPU 153 determines that no skew feed occurs, and continues the rotation of the stepping motors M1 and M2 at the same speed (Step S14).

When the skew feed detection sensors S1*a* and S1*b* are not turned off after elapse of the predetermined time period (NO in Step S15), the CPU 153 determines that conveyance abnormality due to jamming of the original D has occurred, and informs a user of the sheet jam (Step S19). At this time, the CPU 153 disengages the feed clutch 59 and turns off supply of power to the stepping motor M1, M2, and M3 to stop conveyance of the original D.

Meanwhile, when the skew feed detection sensors S1*a* and S1*b* are turned off before elapse of the predetermined time period (YES in Step S15), the CPU 153 gives the original D to the read rollers 36 and 37. Then, image reading is performed, and thereafter the original D is delivered to the original delivery portion 39 by the delivery roller 38. When there is a next original (YES in Step S16), the CPU 153 continues feeding of the original (Step S11). When there is no next original (NO in Step S16), the feeding is ended.

In the first embodiment, the separation portion E stops conveyance at the timing at which the skew feed detection sensors S1*a* and S1*b* detect the original D, and restarts conveyance at the time of starting conveyance of the next original D. During correction of the skew feed by the skew feed correction portion F, the separation portion E is driven to rotate by the original D. Therefore, the separation portion E does not hinder the skew feed correction operation for the original D by the skew feed correction portion F. As long as there is adopted the configuration of not hindering the skew feed correction operation for the original D by the skew feed correction portion F as described above, there may also be adopted a configuration of separating the separation portion E apart to release nipping of the sheet.

In the first embodiment, the correction roller 34*b* is provided at the intermediate position between the correction rollers 34*a* and 34*c* to convey the sheet by the correction roller 34*b*. Therefore, while the skew feed of the original D is corrected by setting the conveyance speed difference to the correction rollers 34*a* and 34*c*, formation of the wrinkles in the original D due to the conveyance resistance or pull-out resistance of the separation portion E can be reduced. In particular, in the first embodiment, the correction roller 34*b* and the separation portion E are provided at the same position in the width direction orthogonal to the original conveyance direction G. Therefore, a conveyance force resisting against the resistance of the separation portion E can be generated efficiently by the correction roller 34*b*, and hence the wrinkles are less liable to be formed in the original. Further, the correction roller 34*b* is positioned at the center between the correction roller 34*a* and the correction roller 34*c*. Therefore, conveyance by the correction roller 34*b* can be performed with less influence on the change in conveyance speed of the correction rollers 34*a* and 34*c* for the skew feed correction.

As described above, in the first embodiment, even with the configuration in which the correction rollers 34*a* and 34*c* are closely arranged downstream of the separation portion E, pulling of the original by the separation portion E and the skew feed correction portion F can be reduced by the correction roller 34*b* arranged between the correction rollers 34*a* and 34*c*, and hence formation of the wrinkles in the original D is less likely to occur. Therefore, the correction rollers 34*a* and 34*c* can be arranged close downstream of the separation portion E, thereby being capable of achieving downsizing of the original conveying apparatus 120.

Further, in the first embodiment, stepping motors, which are excellent in speed responsiveness, are employed as drive sources for the correction rollers 34*a*, 34*b*, and 34*c*. Therefore, detection information of the skew feed detection sensors S1*a* and S1*b* can be promptly reflected to a pulse rate change in motor drive pulse. However, the drive sources for the correction rollers 34*a*, 34*b*, and 34*c* are not limited to the stepping motors, and may be other motors such as DC motors.

Second Embodiment

Figure 8:
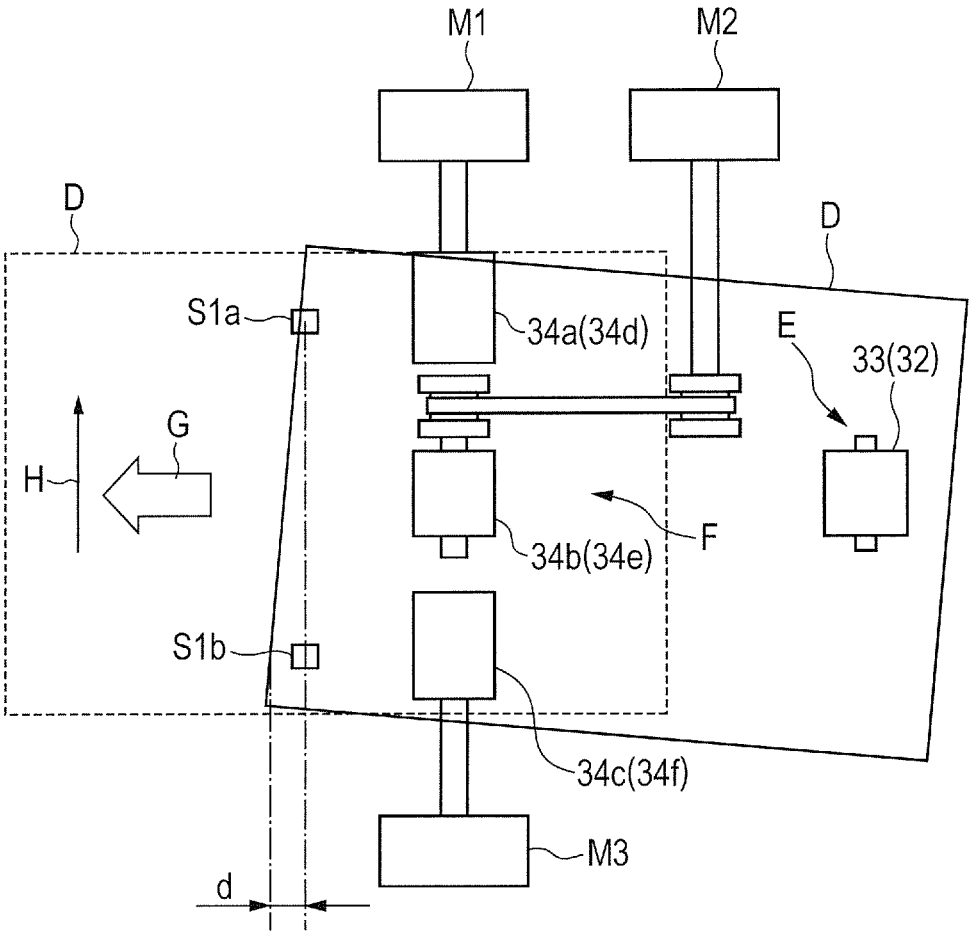
FIG. 8 is an explanatory view for illustrating a skew feed correction portion in a second embodiment of the present invention.

A second embodiment of the present invention will be described with reference to FIG. 8. In the above-mentioned first embodiment, the skew feed detection sensors S1*a* and S1*b* are arranged upstream of the correction rollers 34*a*, 34*b*, and 34*c*. In the second embodiment, the skew feed detection sensors S1*a* and S1*b* are arranged downstream of the correction rollers 34*a*, 34*b*, and 34*c*. Other configurations and actions are the same as those of the above-mentioned first embodiment. Therefore, redundant illustration and description are omitted or simplified, and portions different from the first embodiment will be mainly described.

In the second embodiment, the skew feed detection sensors S1*a* and S1*b* are arranged downstream of the correction rollers 34*a*, 34*b*, and 34*c* in the original conveyance direction G. The skew feed detection sensors S1*a* and S1*b* are arranged apart from each other by a predetermined interval in the width direction H so that respective detection positions for detecting the leading edge of the original are positioned on the same straight line parallel to the width direction H orthogonal to the original conveyance direction G.

In the second embodiment, under a state in which the original D is nipped by the correction rollers 34*a*, 34*b*, and 34*c* and being conveyed, the skew feed amount of the original D is detected by the skew feed detection sensors S1*a* and S1*b*. Therefore, the skew feed amount of the original D can be detected under a state in which the conveyance state is more stable than that in the first embodiment in which the skew feed amount of the original D being conveyed by the separation portion E is detected, thereby being capable of performing more accurate skew feed correction.

In the second embodiment, the skew feed detection sensors S1*a* and S1*b* detect the skew feed amount of the sheet being conveyed by at least the correction roller 34*b*. Therefore, the skew feed amount can be detected under a state in which an edge having been alleviated in warpage through conveyance by the correction roller 34*b* is linear, thereby being capable of controlling the skew feed correction by the correction roller 34*a* and the correction roller 34*c* based on output from the stable skew feed detection sensors S1*a* and S1*b*.

In the second embodiment, a conveyance distance from passage of the leading edge of the original D through the skew feed detection sensors S1*a* and S1*b* to passage of the trailing edge of the original D through the correction rollers 34*a*, 34*b*, and 34*c* is short. Therefore, when the skew feed amount of the original D having a small length in the original conveyance direction G is to be corrected, there is a fear in that the skew feed correction is not completed before the trailing edge of the original D passes through the correction rollers 34*a*, 34*b*, and 34*c*. Therefore, in the case of the original D having a small length in the original conveyance direction G, it is preferred that nip time required for the skew feed correction be secured by reducing the conveyance speed.

Third Embodiment

A third embodiment of the present invention will be described with reference to FIG. 9 to FIG. 12. In the above-mentioned first and second embodiments, the correction rollers 34*a*, 34*b*, and 34*c* are driven by the independent stepping motors M1, M2, and M3, respectively. In the third embodiment, the correction rollers 34*a*, 34*b*, and 34*c* are driven by a common stepping motor M11, and the conveyance speed difference is set to the correction rollers 34*a* and 34*c* by an operation mechanism driven by a stepping motor M12. Other configurations and actions are the same as those of the above-mentioned first embodiment. Therefore, redundant illustration and description are omitted or simplified, and portions different from the first embodiment will be mainly described.

In the third embodiment, the skew feed detection sensors S1*a* and S1*b* are arranged upstream of the correction rollers 34*a*, 34*b*, and 34*c* in the original conveyance direction G. The skew feed detection sensors S1*a* and S1*b* are arranged apart from each other by a predetermined interval in the width direction H so that respective detection positions for detecting the leading edge of the original D are positioned on the same straight line parallel to the width direction H orthogonal to the original conveyance direction G.

Figure 9:
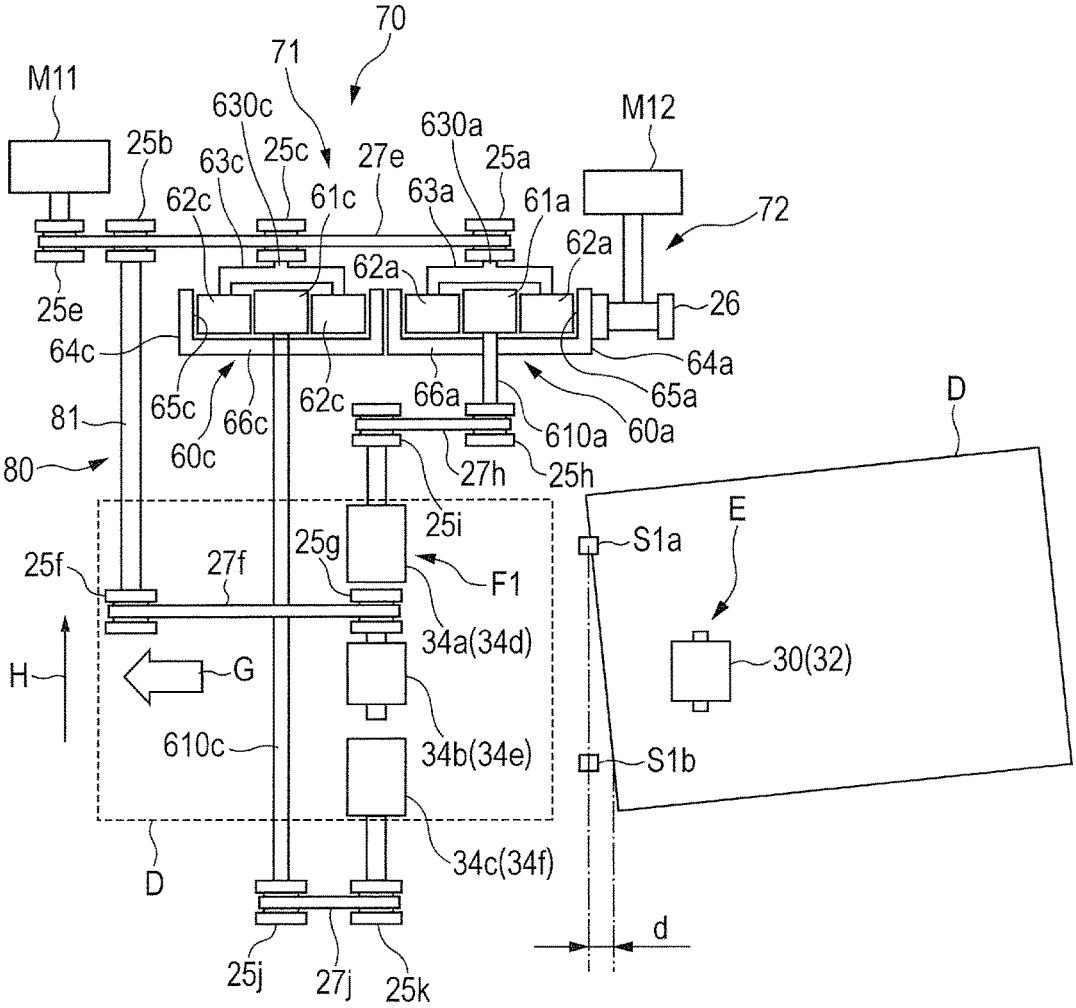
FIG. 9 is an explanatory view for illustrating a skew feed correction portion in a third embodiment of the present invention.

As illustrated in FIG. 9, a skew feed correction portion F1 in the third embodiment includes the stepping motor M11 being a first drive source, the stepping motor M12 being a second drive source, a speed-changing portion being a speed difference setting device (a speed difference forming device), and a third drive transmission portion 80 being a drive transmission device. The speed-changing portion 70 includes a first drive transmission portion 71, a second drive transmission portion 72, and planetary gear mechanisms 60*a* and 60*c*. The speed-changing portion 70 is capable of transmitting drive of the stepping motor M11 to the correction roller 34*a* being the first conveyance rotary member and the correction roller 34*c* being the second conveyance rotary member. Further, the speed-changing portion 70 is capable of setting the speed difference between the correction roller 34*a* and the correction roller 34*c* by transmitting drive of the stepping motor M12 in superposition with the drive of the stepping motor M11.

The first drive transmission portion 71 transmits drive from the stepping motor M11 to the planetary gear mechanisms 60*a* and 60*c*. Specifically, the drive transmission portion 71 includes a pulley 25*e* fixed to a rotary shaft of the stepping motor M11, pulleys 25*c* and 25*a* fixed to shafts of the planetary gear mechanisms 60*a* and 60*c* on drive input side, respectively, and a belt 27*e* stretched around the pulleys 25*e*, 25*c*, and 25*a*.

The second drive transmission portion 72 also transmits drive from the stepping motor M12 to the planetary gear mechanisms 60*a* and 60*c*. Specifically, the second drive transmission portion 72 includes a gear 26 fixed to a rotary shaft of the stepping motor M12, and the gear 26 is in mesh with an outer gear portion 64, which will be described later and is formed on an outer peripheral surface of a ring gear 66*a* of the planetary gear mechanism 60*a* described later. The outer gear portion 64*a* of the ring gear 66*a* is in mesh with an outer gear portion 64*c*, which is adjacent to the outer gear 64*a* and is formed on an outer peripheral surface of a ring gear 66*c* of the planetary gear mechanism 60*c*.

(Planetary Gear Mechanism)

Figure 10A:
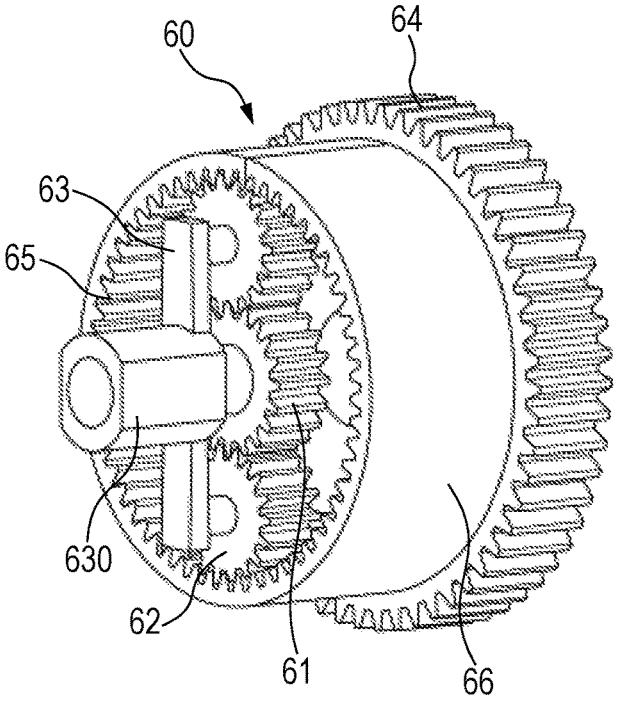
FIG. 10A is a perspective view for illustrating a planetary gear mechanism in the third embodiment.
Figure 10B:
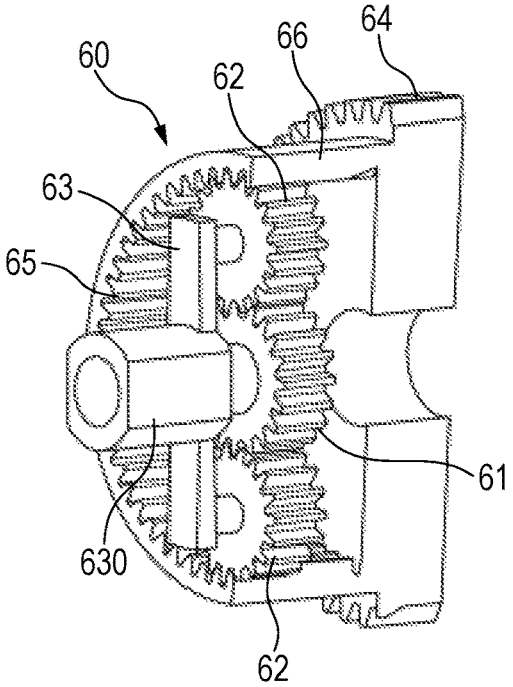
FIG. 10B is a perspective view for illustrating the planetary gear mechanism, which is partially cut in the illustration.

A description will be provided of the above-mentioned planetary gear mechanisms 60*a* and 60*c* with reference to FIG. 9, FIG. 10A, and FIG. 10B. The planetary gear mechanisms 60*a* and 60*c* have the same configuration. Therefore, in FIG. 10A and FIG. 10B, the suffixes a and c which distinguish the two planetary gear mechanisms 60*a* and 60*c* are omitted. As illustrated in FIG. 10A, the planetary gear mechanism 60 includes a sun gear 61, a ring gear 66, planetary gears 62, and a carrier 63.

The sun gear 61 is fixed to each of the rotary shafts 610*a* and 610*c*. As illustrated in FIG. 9, the rotary shaft 610*a* fixed to the sun gear 61*a* of the planetary gear mechanism 60*a* is fixed to a pulley 25*h*, and is connected to the correction roller 34*a* through intermediation of a belt 27*h* and a pulley 25*i* so as to be capable of transmitting drive. The rotary shaft 610*c* fixed to the sun gear 61*c* of the planetary gear mechanism 60*c* is fixed to a pulley 25*j*, and is connected to the correction roller 34*c* through intermediation of a belt 27*j* and a pulley 25*k* so as to be capable of transmitting drive.

The ring gear 66 is a cylindrical gear which is arranged so as to be coaxial with the sun gear 61 and surround a periphery of the sun gear 61, and has an inner gear portion 65 on an inner peripheral surface and the outer gear portion 64 on an outer peripheral surface. As described above, the outer gear portion 64*a* of the planetary gear mechanism 60*a* and the outer gear portion 64*c* of the planetary gear mechanism 60*c* are in mesh with each other.

In a space formed between the sun gear 61 and the ring gear 66, a plurality of (two in the illustrated example) planetary gears 62 are arranged so as to be in mesh with the sun gear 61 and the inner gear portion 65. Respective rotary shafts of the plurality of planetary gears 62 are supported by the carrier 63. Therefore, the planetary gears 62 are rotatable about respective axes, and are revolvable together with the carrier 63 around the sun gear 61. A rotation center shaft 630 of the carrier 63 is coaxial with a rotation center shaft of the sun gear 61, and is connected to the first drive transmission portion 71. That is, a rotation center shaft 630*a* of the planetary gear mechanism 60*a* is fixed to the pulley 25*a* of the first drive transmission portion 71. A rotation center shaft 630*c* of the planetary gear mechanism 60*c* is fixed to the pulley 25*c* of the first drive transmission portion 71.

The third drive transmission portion 80 is capable of transmitting the drive of the stepping motor M11 to the correction roller 34*b* being the third conveyance rotary member without intermediation of the speed-changing portion 70. Specifically, the third drive transmission portion 80 includes a pulley 25*b* around which the belt 27*e* is stretched, a pulley 25*f* connected to the pulley 25*b* through intermediation of the rotary shaft 81, a pulley 25*g* fixed to the rotary shaft of the correction roller 34*b*, and a belt 27*f* stretched around the pulleys 25*f* and 25*g*. Thus, the drive of the stepping motor M11 is transmitted to the correction roller 34*b* through intermediation of the pulley 25*e*, the belt 27*e*, the pulley 25*b*, the rotary shaft 81, the pulley 25*f*, the belt 27*f*, and the pulley 25*g*.

The drive of the stepping motor M11 is transmitted also to carriers 63*a* and 63*c* of the planetary gear mechanisms 60*a* and 60*c* through intermediation of the pulley 25*e*, the belt 27*e*, and the pulleys 25*a* and 25*c*. The planetary gears 62*a* and 62*c* revolve together with the carriers 63*a* and 63*c* so that the sun gears 61*a* and 61*c* rotate. The rotation of the sun gear 61*a* is transmitted to the correction roller 34*a* through intermediation of the rotary shaft 610*a*, the pulley 25*h*, the belt 27*h*, and the pulley 25*i*. The rotation of the sun gear 61*c* is transmitted to the correction roller 34*c* through intermediation of the rotary shaft 610*c*, the pulley 25*j*, the belt 27*j*, and the pulley 25*k*.

As described above, the drive of the stepping motor M12 is transmitted to the outer gear portion 64*a* of the ring gear 66*a* of the planetary gear mechanism 60*a* through intermediation of the gear 26. Further, the drive of the stepping motor M12 is transmitted from the outer gear portion 64*a* to the outer gear portion 64*c* of the ring gear 66*c* of the planetary gear mechanism 60*c*. The outer gear portions 64*a* and 64*c* are directly in mesh with each other, and hence rotation directions of the ring gears 66*a* and 66*c* are opposite to each other.

Thus, when the stepping motor M12 rotates, due to different rotation directions of the ring gears 66*a* and 66*c*, the drive transmitted to the sun gears 61*a* and 61*c* through intermediation of the inner gear portions 65*a* and 65*c* and the planetary gears 62*a* and 62*c* acts so as to increase one of the sun gears 61*a* and 61*c* in speed and reduce another of the sun gears 61*a* and 61*c* in speed in accordance with the rotation direction of the stepping motor M12. Therefore, through transmission of the drive of the stepping motor M12 in superposition with the drive of the stepping motor M11, the speed-changing portion 70 is capable of changing the rotation speeds of the sun gears 61*a* and 61*c*. As described above, the sun gears 61*a* and 61*c* are connected to the correction rollers 34*a* and 34*c*, respectively. Therefore, through changes in rotation speed of the sun gears 61*a* and 61*c*, a speed difference can be set between the correction roller 34*a* and the correction roller 34*c*.

Specifically, when the stepping motor M12 is stopped, the drive of the stepping motor M11 causes a rotation speed equal to the rotation speeds of the carriers 63*a* and 63*c* to be output to the sun gears 61*a* and 61*c*. With this action, the correction rollers 34*a* and 34*c* rotate at the same speed in the same direction.

When the stepping motor M12 rotates, for example, a rotation speed which is obtained by adding the rotation speed of the ring gear 66*a* to the rotation speed of the carrier 63*a* is output to the sun gear 61*a*. Meanwhile, a rotation speed which is obtained by subtracting the rotation speed of the ring gear 66*c* from the rotation speed of the carrier 63*c* is output to the sun gear 61*c*. With those actions, a speed difference is set to the conveyance speeds of the correction rollers 34*a* and 34*c*.

The conveyance speed of the correction roller 34*b* is set so as to be equal to the conveyance speeds of the correction rollers 34*a* and 34*c* given when the stepping motor M12 is stopped. Further, when the speed difference is set to the correction rollers 34*a* and 34*c* by rotation of the stepping motor M12, the conveyance speed of the correction roller 34*b* is set to a conveyance speed between the conveyance speed of the correction roller 34*a* and the conveyance speed of the correction roller 34*c*. In particular, in the third embodiment, the conveyance speed of the correction roller 34*b* is set to a median value.

(Skew Feed Correction Control)

Figure 11:
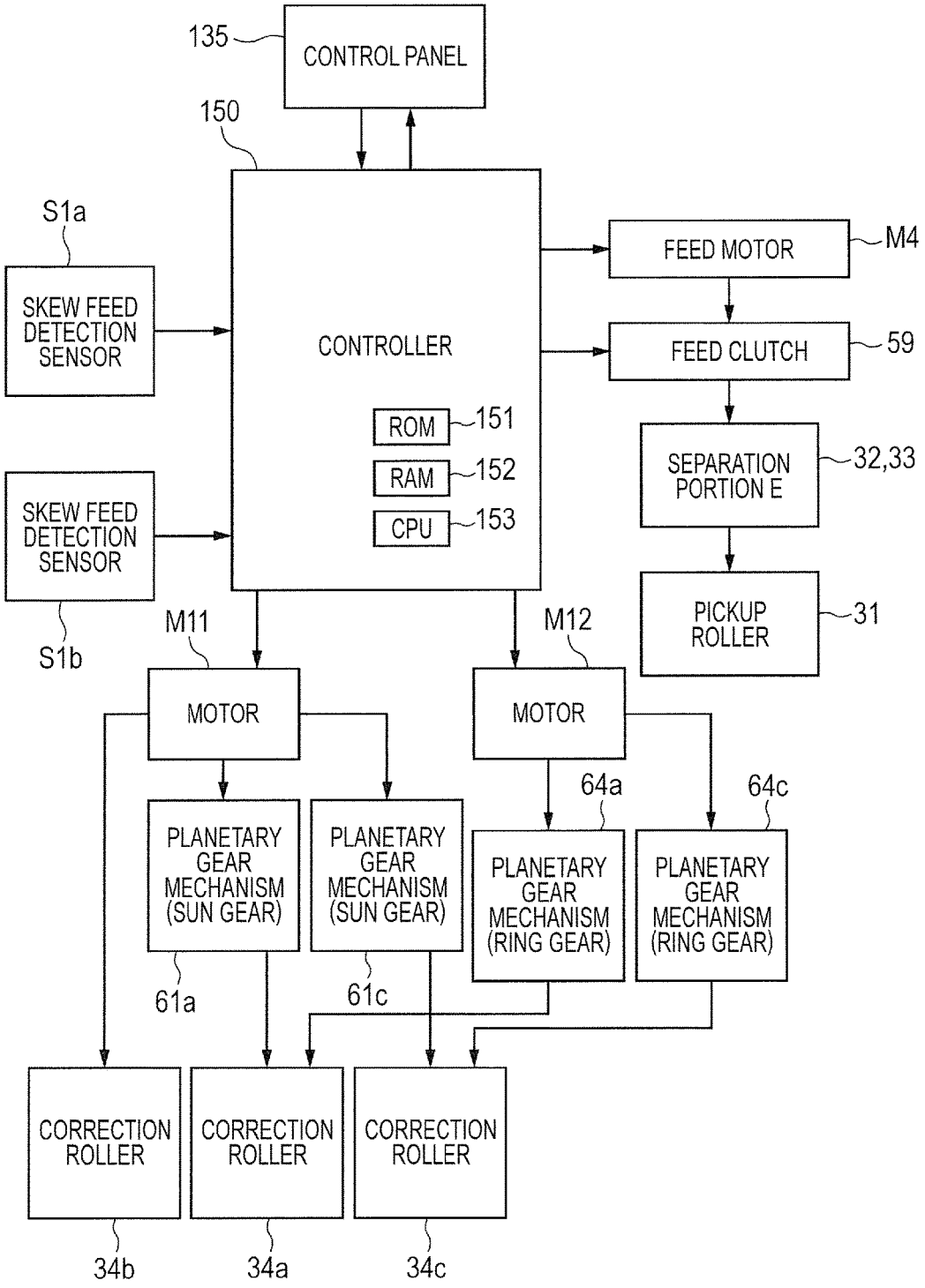
FIG. 11 is a block diagram for illustrating a control system for an original conveying apparatus in the third embodiment.

FIG. 11 is a block diagram for illustrating a control system for an original conveying apparatus in the third embodiment. As illustrated in FIG. 11, the controller 150 controls the stepping motors M11 and M12 to drive the correction rollers 34*a*, 34*b*, and 34*c* to set the conveyance speed difference between the correction rollers 34*a* and 34*c*. The controller 150 sets the conveyance speed difference between the correction rollers 34*a* and 34*c* based on detection results of the skew feed detection sensors S1*a* and S1*b*. Other configurations are the same as those in FIG. 6 mentioned above.

Figure 12:
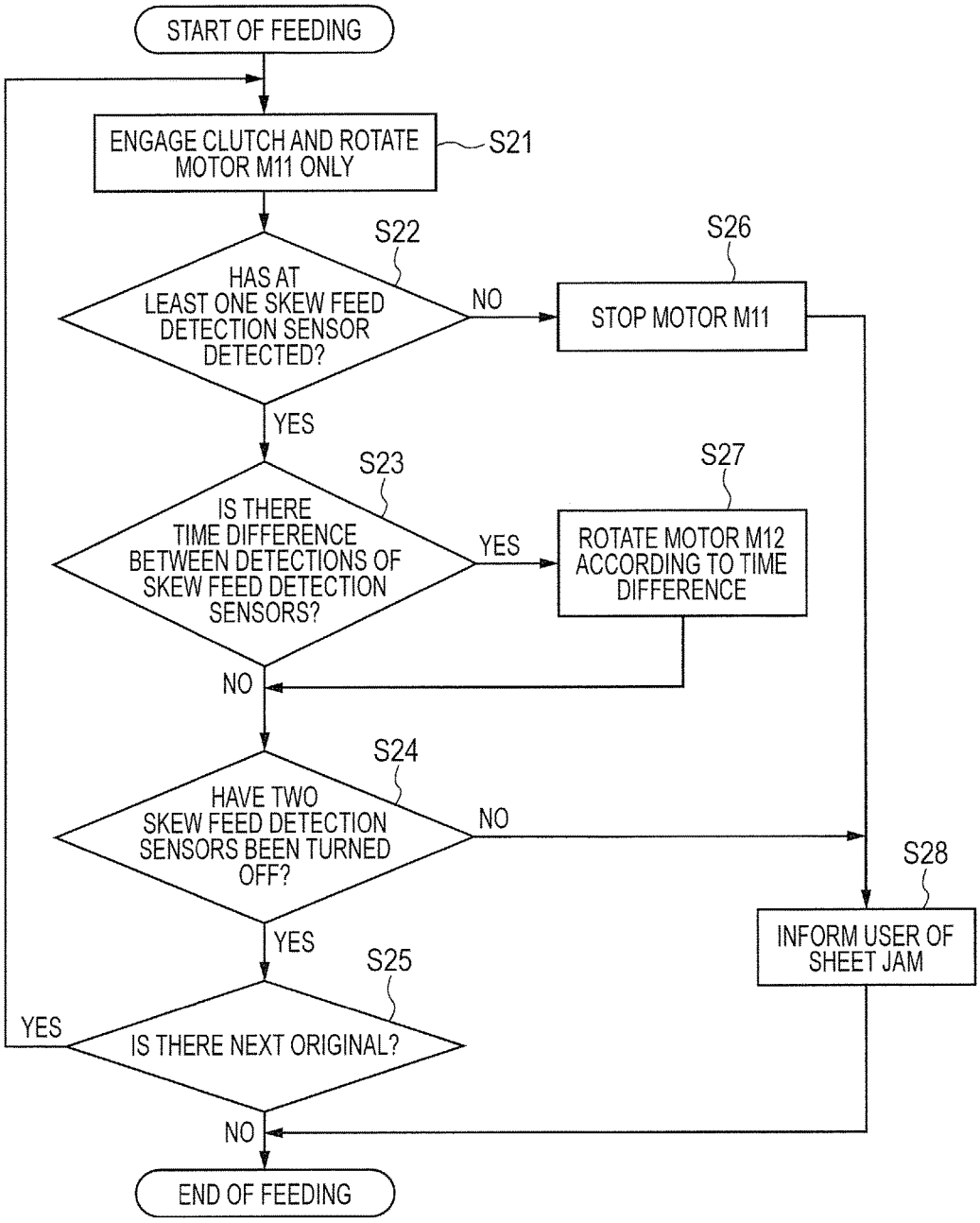
FIG. 12 is a flowchart for illustrating skew feed correction control for the original conveying apparatus in the third embodiment.

With reference to FIG. 11 and FIG. 12, a description will be provided of an example of a flow of control in the third embodiment. When a command to start image reading is given, the CPU 153 engages the feed clutch 59 and, at the same time, operates the stepping motor M11 (Step S21).

At this time, the pickup roller 31, the conveyance roller 32, and the retard roller 33 operate, and the correction rollers 34*a*, 34*b*, and 34*c* rotate at the same speed to wait for the original D. After elapse of a predetermined time period, when none of the skew feed detection sensors S1*a* and S1*b* detects the leading edge of the original D (NO in Step S22), the CPU 153 determines that conveyance abnormality due to jamming of the original D has occurred, stops the stepping motor M11 (Step S26), and informs a user of the jamming of the original (sheet) (Step S28).

When at least one of the skew feed detection sensors S1*a* and S1*b* detects the leading edge of the original D before elapse of a predetermined time period (YES in Step S22), the CPU 153 determines whether or not there is a time difference between detections by the skew feed detection sensors S1*a* and S1*b* (Step S23). When there is the time difference (YES in Step S23), the CPU 153 calculates a skew feed amount of the original D based on the detection results, and rotates the stepping motor M12 in accordance with the skew feed amount (Step S27). At this time, the rotation of the stepping motor M12 is maintained for a time period corresponding to the skew feed amount (time difference in Step S23). After elapse of this time period, the rotation of the stepping motor M12 is stopped.

When there is no time difference between the detections by the skew feed detection sensors S1*a* and S1*b*, that is, when the skew feed detection sensors S1*a* and S1*b* detect the leading edge of the original D at the same time (NO in Step S23), the CPU 153 determines that no skew feed occurs, and continues the rotation of the stepping motor M11 at the same speed and stops the stepping motor M12.

When the skew feed detection sensors S1*a* and S1*b* are not turned off after elapse of the predetermined time period (NO in Step S24), the CPU 153 determines that conveyance abnormality due to jamming of the original D has occurred, and informs a user of the sheet jam (Step S28). At this time, the CPU 153 disengages the feed clutch 59 and turns off supply of power to the stepping motor M11 to stop conveyance of the original D.

When the skew feed detection sensors S1*a* and S1*b* are turned off before elapse of the predetermined time period (YES in Step S24), the CPU 153 gives the original D to the read rollers 36 and 37. Then, image reading is performed, and thereafter the original D is delivered to the original delivery portion 39 by the delivery roller 38. When there is a next original (YES in Step S25), the CPU 153 continues feeding (Step S21). When there is no next original (NO in Step S25), the feeding is ended.

In the third embodiment, the speed difference of the conveyance speeds of the correction rollers 34*a* and 34*c* is set through use of the planetary gear mechanisms 60*a* and 60*c*, and hence speed control of the correction rollers 34*a* and 34*c* can be performed through use of two motors. Further, of the two motors, the stepping motor M11 for driving the correction rollers 34*a* and 34*c* can be used also for driving of the correction roller 34*b*. Therefore, even with the configuration in which three conveyance rotary members are provided, the number of motors being drive sources may be two.

Further, in the third embodiment, while the correction rollers 34*a* and 34*c* are rotated by the stepping motor M11, speed adjustment for the skew feed correction can be performed with respect to the correction rollers 34*a* and 34*c* through use of the stepping motor M12. Therefore, as compared to the case of the first embodiment in which the correction rollers 34*a* and 34*c* are rotated by independent motors, respectively, synchronization of the correction rollers 34*a* and 34*c* in rotation, stoppage, acceleration, and deceleration can easily be performed, thereby being capable of suppressing variation in rotation speed of the correction rollers 34*a* and 34*c* and in timing of starting and stopping rotation of correction rollers 34*a* and 34*c*. For example, stoppage and start of the rotation of the correction rollers 34*a* and 34*c* can be performed through stoppage and activation of one stepping motor M11. Therefore, as compared to the case of synchronizing stoppage or activation of a plurality of motors, the operations of the correction rollers 34*a* and 34*c* can easily be synchronized, and conveyance control can be performed more accurately.

Fourth Embodiment

Figure 13:
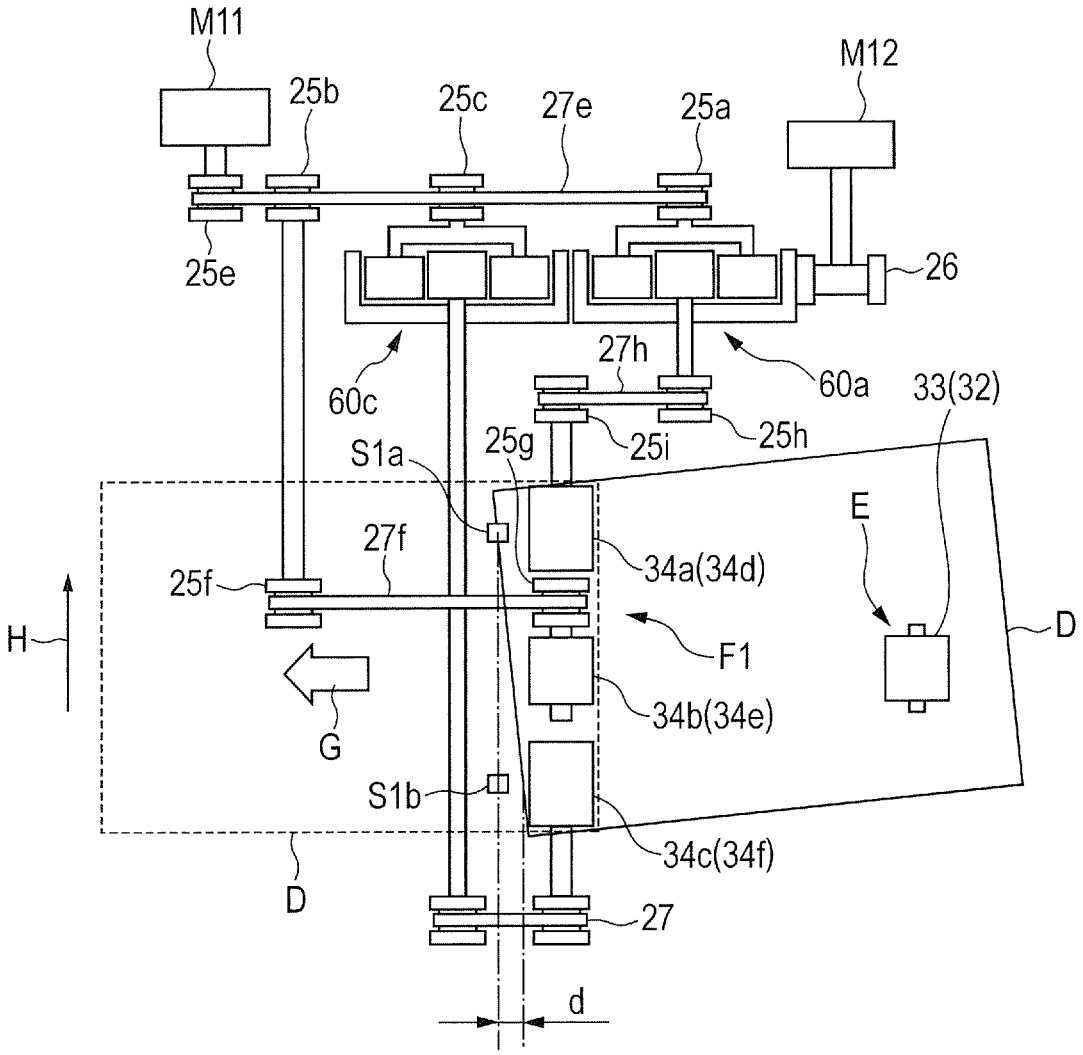
FIG. 13 is an explanatory view for illustrating a skew feed correction portion in a fourth embodiment of the present invention.

A fourth embodiment of the present invention will be described with reference to FIG. 13. In the above-mentioned third embodiment, the skew feed detection sensors S1*a* and S1*b* are arranged upstream of the correction rollers 34*a*, 34*b*, and 34*c*. In the fourth embodiment, the skew feed detection sensors S1*a* and S1*b* are arranged downstream of the correction rollers 34*a*, 34*b*, and 34*c*. Other configurations and actions are the same as those of the above-mentioned third embodiment. Therefore, redundant illustration and description are omitted or simplified, and portions different from the third embodiment will be mainly described.

In the fourth embodiment, the skew feed detection sensors S1*a* and S1*b* are arranged downstream of the correction rollers 34*a*, 34*b*, and 34*c* in the original conveyance direction G. The skew feed detection sensors S1*a* and S1*b* are arranged apart from each other by a predetermined interval in the width direction H so that respective detection positions for detecting the leading edge of the original D are positioned on the same straight line parallel to the width direction H orthogonal to the original conveyance direction G.

Similarly to the second embodiment, in the fourth embodiment, under a state in which the original D is nipped by the correction rollers 34*a*, 34*b*, and 34*c* and being conveyed, the skew feed amount of the original D is detected by the skew feed detection sensors S1*a* and S1*b*. Therefore, the skew feed amount of the original D can be detected under a state in which the conveyance state is more stable than that in the third embodiment in which the skew feed amount of the original D being conveyed by the separation portion E is detected, thereby being capable of performing more accurate skew feed correction. Other actions and effects are the same as those of the second embodiment.

Fifth Embodiment

A fifth embodiment of the present invention will be described with reference to FIG. 14. In the first to fourth embodiments described above, a description will be provided of embodiments in which skew feed correction for an original in an image reading apparatus is performed. In the fifth embodiment, a description will be provided of an embodiment for a feeding unit of an electrophotographic image forming apparatus.

(Image Forming Apparatus)

Figure 14:
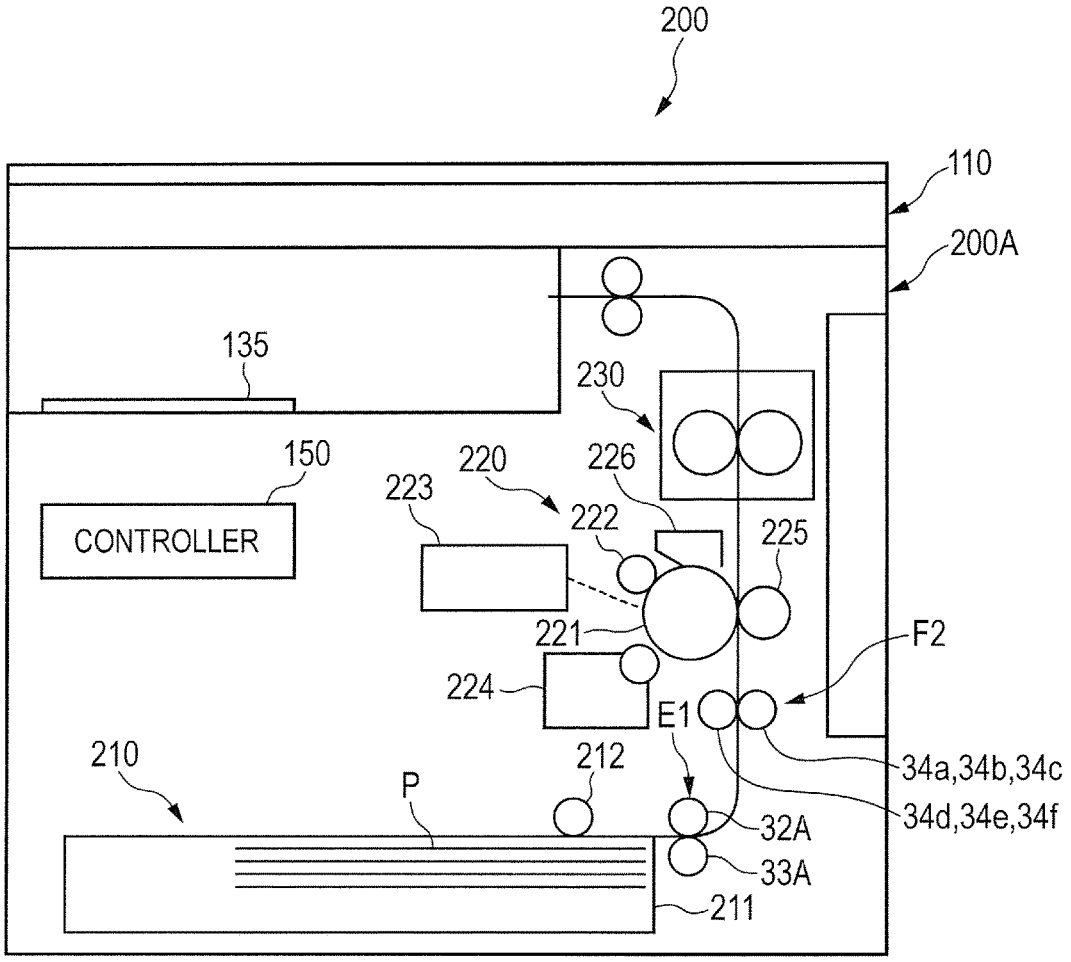
FIG. 14 is an explanatory view for illustrating a configuration of a copying machine in a fifth embodiment of the present invention.

FIG. 14 is an explanatory view for illustrating a configuration of a copying machine 200 according to the fifth embodiment of the present invention. The separation portion E1 and the skew feed correction portion F2 in the fifth embodiment have the same configuration as that of the first embodiment. Therefore, in FIG. 14, components which are common to the first embodiment are denoted by reference symbols which are common to FIG. 6 and FIG. 8, and redundant description is omitted.

As illustrated in FIG. 14, the copying machine 200 is an electrophotographic image forming apparatus in which the image reading unit 110 is arranged in an upper portion of an apparatus main body 200A. An image forming unit 220 being an example of an image forming device and a fixing device 230 form an image on a sheet P having been subjected to skew feed correction by a feeding unit 210 being an example of a sheet conveying apparatus. The image forming unit 220 forms a toner image through execution of an electrophotographic process and transfers the sheet P having been fed from the feeding unit 210.

The image forming unit 220 includes a charge roller 222, an exposure device 223, a developing device 224, a transfer roller 225, and a drum cleaning device 226, which are arranged around a photosensitive drum 211. The charge roller 222 charges a peripheral surface of the photosensitive drum 221 to a uniform potential. The exposure device 223 scans and exposes the photosensitive drum 221 with use of a laser beam modulated in accordance with information of an image to be formed, to thereby form an electrostatic latent image on the photosensitive drum 221.

The developing device 224 develops an electrostatic latent image on the photosensitive drum 221 with toner (developer), to thereby form a toner image on the photosensitive drum 221. The transfer roller 225 receives a transfer voltage applied thereto, and transfers the toner image on the photosensitive drum 221 to the sheet P having been fed from the feeding unit 210. The drum cleaning device 226 cleans the photosensitive drum 221 after the transfer of the toner image onto the sheet P.

The sheet P having the toner image transferred thereto is conveyed to the fixing device 230 and is heated and pressurized by the fixing device 230 so that the image is fixed thereon. After that, the sheet P is delivered to a predetermined delivery tray.

(Feeding Unit)

The feeding unit 210 picks up the sheets P stacked in a cassette 211 one after another and conveys the sheets P to the image forming unit 220. As described above in relation to the step in which the sheet P is nipped and conveyed in the image forming unit 220, the toner image is transferred to the sheet P.

The pickup roller 212 rotates while being held in abutment against an upper most sheet P stacked in the cassette 211, to thereby feed the sheet P from the cassette 211 and convey the sheet P to the separation portion E1.

The separation portion E1 includes a conveyance roller 32A, which rotates in a sheet conveyance direction, and a retard roller 33A, which forms a separation nip with the conveyance roller 32A. The retard roller 33A is driven in a direction of conveying the sheet in a direction opposite to the sheet conveyance direction of the conveyance roller 32A, and is capable of being driven by the conveyance roller 32A. At such separation portion E1, while the conveyance roller 32A conveys the sheet P on an uppermost surface to the skew feed correction portion F2 downstream of the separation portion E1, the retard roller 33A pushes back a multi-fed sheet, which is fed together with the sheet P, to the cassette 211. Further, when one sheet is conveyed to the separation portion E1, the retard roller 33A is driven by the conveyance roller 32A to rotate, thereby conveying the sheet to the skew feed correction portion F2.

Similarly to FIG. 5, in the skew feed correction portion F2, the rollers 34*d*, 34*e*, and 34*f* are held in abutment against the correction rollers 34*a*, 34*b*, and 34*c*, respectively, to form nips Na, Nb, and Nc. The skew feed correction portion F2 corrects skew feed of the sheet P having been given by the separation portion E1 and thereafter conveys the sheet P to a transfer portion at which the photosensitive drum 221 and the transfer roller 225 are held in abutment against each other. In the description above, the configuration described in the first embodiment is applied to the image forming apparatus according to the fifth embodiment. However, any one of the second to fourth embodiments may be applied to the above-mentioned image forming apparatus.

Other Embodiments

The sheet conveying apparatus according to the present invention is not limited to the specific configurations described in the first to fourth embodiments. The present invention may be implemented with other embodiments in which part or all of the configurations of the first to fourth embodiments are replaced with equivalent members. The first conveyance rotary member, the second conveyance rotary member, and the third conveyance rotary member may be replaced with a conveyance belt stretched around a plurality of conveyance rollers or support rollers.

In the first to fifth embodiments, the correction roller 34*b* being the third conveyance rotary member is arranged downstream of the separation portion in the sheet conveyance direction. However, the place of arrangement of the correction roller 34*b* is not limited to downstream of the separation portion. For example, the correction roller 34*b* may be arranged, for example, at a position far apart to downstream from the separation portion E, a position downstream of a source of generation of the conveyance resistance which is different from the separation portion E, or a position downstream of the conveyance means different from the separation portion E.

In the first to fifth embodiments, a description will be provided of the configuration in which the correction rollers 34*a* and 34*c* are arranged on both sides of the sheet in the width direction orthogonal to the conveyance direction, respectively, to correct the skew feed of the sheet. However, the present invention is also applicable to a configuration in which a plurality of (for example, two) correction rollers are arranged on each of both sides in the width direction to correct the skew feed of the sheet. For example, when two correction rollers are arranged on each of both sides in the width direction, the two correction rollers on one side in the width direction may be considered as one first conveyance rotary member, and the two correction rollers on another side in the width direction may be considered as one second conveyance rotary member. Thus, in this case, one or a plurality of correction rollers being the third conveyance rotary member is arranged between the first conveyance rotary member and the second conveyance rotary member.

For example, respective correction rollers arranged upstream of the first conveyance rotary member and the second conveyance rotary member in the sheet conveyance direction are assumed to be a pair of upstream rollers. Similarly, respective correction rollers arranged downstream in the sheet conveyance direction are assumed to be a pair of downstream rollers. In this case, one correction roller being the third conveyance rotary member may be arranged between the pair of upstream rollers and between the pair of downstream rollers. Alternatively, one correction roller being the third conveyance rotary member may be arranged at a center of the pair of upstream rollers and the pair of downstream rollers in the sheet conveyance direction and at a center between the first conveyance rotary member and the second conveyance rotary member.

In the first to fifth embodiments, a description will be provided of the configuration in which the correction roller 34*b* being the third conveyance rotary member is driven by the motor. However, the correction roller 34*b* may be driven to rotate along with conveyance of the sheet, rather than being driven by the motor. Even with such configuration, the sheet can be pressed by the correction roller 34*b* between the correction rollers 34*a* and 34*c*. Therefore, as compared to the case in which the correction roller 34*b* is not provided, wrinkles formed in the sheet which are caused by, for example, the pull-out resistance at the separation portion can be reduced.

In the third and fourth embodiments, the planetary gear mechanism is used to change the conveyance speed difference of the correction rollers 34*a* and 34*c*. However, a differential mechanism other than the planetary gear mechanism may be used. For example, a bevel gear differential mechanism may be used.

In the third and fourth embodiments, a description will be provided of the planetary gear which is designed so that the correction rollers 34*a* and 34*c* driven by the stepping motor M11 rotate at the same rotation speed under a state in which the stepping motor M12 is stopped. However, the planetary gear mechanism may be designed so that the correction rollers 34*a* and 34*c* rotate at the same rotation speed under a state in which the stepping motor M12 rotates at a predetermined rotation speed V. At this time, the planetary gear mechanism can be designed so that the conveyance speed difference is set to the correction roller 34*a* and 34*c* by changing the rotation speed V of the stepping motor M12 to $\pm\Delta V$. The selection and layout of the drive gear and the planetary gear in the planetary gear mechanism as well as detailed structure thereof can be changed or corrected in design in various manners within the scope of the claims at the time of actual implementation.

The sheet conveying apparatus according to the embodiments may be applied to various portions along the conveyance passage of the sheet in various apparatus other than original conveying apparatus to be mounted to, for example, a copying machine, a scanner, or a facsimile machine. As described in the fifth embodiment, the sheet conveying apparatus may be applied to the feeding unit, which is mounted to the image forming apparatus and is configured to convey an unused sheet. The sheet conveying apparatus may be applied to, for example, a copying machine, a printer, a facsimile, and various printing machines to feed a sheet having been subjected to the skew feed correction to the image forming unit. The sheet conveying apparatus according to the present invention may be applied to a sheet processing apparatus configured to perform sheet processing such as aligning and stacking of sheets, book binding, punching, and stapling to feed a sheet having been subjected to skew feed correction to a sheet processing unit.

In the sheet conveying apparatus according to the embodiments, wrinkles are less liable to be formed in the sheet during sheet conveyance.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-056177, filed Mar. 22, 2017, and Japanese Patent Application No. 2018-022280, filed Feb. 9, 2018, which are hereby incorporated by reference herein in their entirety.

What is claimed is:

1. A sheet conveying apparatus, comprising:

a separation-conveyance portion configured to separate and convey a sheet;

a first conveyance rotary member, which is provided downstream of the separation-conveyance portion in a sheet conveyance direction and is configured to further convey the sheet at a predetermined conveyance speed in contact with the sheet being conveyed by the separation-conveyance portion;

a second conveyance rotary member, which is provided downstream of the separation-conveyance portion in the sheet conveyance direction, is arranged apart from the first conveyance rotary member by a predetermined interval in a width direction orthogonal to the sheet conveyance direction, and is configured to convey the sheet being conveyed by the separation-conveyance portion in cooperation with the first conveyance rotary member;

a third conveyance rotary member, which is arranged at a position between a position at a most downstream end of the separation-conveyance portion and a position at a most downstream end of the first conveyance rotary member or the second conveyance rotary member in the sheet conveyance direction and is configured to convey the sheet being conveyed by the separation-conveyance portion; and a controller configured to set a conveyance speed of the first conveyance rotary member, a conveyance speed of the second conveyance rotary member, and a conveyance speed of the third conveyance rotary member, wherein the controller is able to set the conveyance speed of the sheet by the second conveyance rotary member to a first conveyance speed, which is the same as a conveyance speed of the sheet by the first conveyance rotary member, and a second conveyance speed which is different from the first conveyance speed, and wherein, when the controller sets the conveyance speed of the sheet by the first conveyance rotary member to the first conveyance speed and sets the conveyance speed of the sheet by the second conveyance rotary member to the second conveyance speed, the controller sets the conveyance speed of the sheet by the third conveyance rotary member to a third conveyance speed which is a speed between the first conveyance speed and the second conveyance speed.

2. A sheet conveying apparatus according to claim 1, wherein, when the controller sets the conveyance speed of the sheet by the first conveyance rotary member to the first conveyance speed and sets the conveyance speed of the sheet by the second conveyance rotary member to the first conveyance speed, the controller sets the conveyance speed of the sheet by the third conveyance rotary member to the first conveyance speed.

3. A sheet conveying apparatus according to claim 1, wherein the separation-conveyance portion comprises:

a separation member configured to separate sheets; and a conveyance member configured to convey the sheet in the sheet conveyance direction, and wherein the third conveyance rotary member is arranged at a position at which the third conveyance rotary member at least partially overlaps with the separation member in the width direction as seen in the sheet conveyance direction and at which the third conveyance rotary member overlaps with at least one of the first conveyance rotary member and the second conveyance rotary member in the sheet conveyance direction as seen in the width direction.

4. A sheet conveying apparatus according to claim 1, further comprising a sheet detector configured to detect a leading edge of a sheet to be conveyed at a plurality of positions, wherein, based on a detection result of the sheet detector, the controller sets the conveyance speed of the sheet by the second conveyance rotary member to the first conveyance speed and the second conveyance speed.

5. A sheet conveying apparatus according to claim 4, wherein the sheet detector is arranged upstream of the first conveyance rotary member and the second conveyance rotary member in the sheet conveyance direction.

6. A sheet conveying apparatus according to claim 4, wherein the sheet detector is arranged downstream of the first conveyance rotary member and the second conveyance rotary member in the sheet conveyance direction.

7. A sheet conveying apparatus according to claim 1, further comprising:

a first drive device configured to drive the first conveyance rotary member;

a second drive device configured to drive the second conveyance rotary member; and a third drive device configured to drive the third conveyance rotary member.

8. A sheet conveying apparatus according to claim 1, further comprising:

a first drive source;

a second drive source; and a speed difference setting device configured to set a speed difference between the first conveyance rotary member and the second conveyance rotary member by transmitting drive of the first drive source to the first conveyance rotary member and the second conveyance rotary member and transmitting drive of the second drive source in superposition to the drive of the first drive source.

9. A sheet conveying apparatus according to claim 8, further comprising a drive transmission device configured to transmit the drive of the first drive source to the third conveyance rotary member without intermediation of the speed difference setting device.

10. A sheet conveying apparatus according to claim 1, wherein the third conveyance speed is an average value of the first conveyance speed and the second conveyance speed.

11. An image reading apparatus, comprising:

an image reading device configured to read an image of a conveyed sheet;

a separation-conveyance portion configured to separate and convey a sheet;

a first conveyance rotary member, which is provided downstream of the separation-conveyance portion in a sheet conveyance direction and is configured to further convey the sheet at a predetermined conveyance speed in contact with the sheet being conveyed by the separation-conveyance portion;

a second conveyance rotary member, which is provided downstream of the separation-conveyance portion in the sheet conveyance direction, is arranged apart from the first conveyance rotary member by a predetermined interval in a width direction orthogonal to the sheet conveyance direction, and is configured to convey the sheet being conveyed by the separation-conveyance portion in cooperation with the first conveyance rotary member;

a third conveyance rotary member, which is arranged at a position between a position at a most downstream end of the separation-conveyance portion and a position at a most downstream end of the first conveyance rotary member or the second conveyance rotary member in the sheet conveyance direction and is configured to convey the sheet being conveyed by the separation-conveyance portion; and a controller configured to set a conveyance speed of the first conveyance rotary member, a conveyance speed of the second conveyance rotary member, and a conveyance speed of the third conveyance rotary member, wherein the controller is able to set the conveyance speed of the sheet by the second conveyance rotary member to a first conveyance speed, which is the same as a conveyance speed of the sheet by the first conveyance rotary member, and a second conveyance speed which is different from the first conveyance speed, and wherein, when the controller sets the conveyance speed of the sheet by the first conveyance rotary member to the first conveyance speed and sets the conveyance speed of the sheet by the second conveyance rotary member to the second conveyance speed, the controller sets the conveyance speed of the sheet by the third conveyance rotary member to a third conveyance speed which is a speed between the first conveyance speed and the second conveyance speed.

12. An image forming apparatus, comprising:

an image forming device configured to form an image on a conveyed sheet;

a separation-conveyance portion configured to separate and convey a sheet;

a first conveyance rotary member, which is provided downstream of the separation-conveyance portion in a sheet conveyance direction and is configured to further convey the sheet at a predetermined conveyance speed in contact with the sheet being conveyed by the separation-conveyance portion;

a second conveyance rotary member, which is provided downstream of the separation-conveyance portion in the sheet conveyance direction, is arranged apart from the first conveyance rotary member by a predetermined interval in a width direction orthogonal to the sheet conveyance direction, and is configured to convey the sheet being conveyed by the separation-conveyance portion in cooperation with the first conveyance rotary member;

a third conveyance rotary member, which is arranged at a position between a position at a most downstream end of the separation-conveyance portion and a position at a most downstream end of the first conveyance rotary member or the second conveyance rotary member in the sheet conveyance direction and is configured to convey the sheet being conveyed by the separation-conveyance portion; and a controller configured to set a conveyance speed of the first conveyance rotary member, a conveyance speed of the second conveyance rotary member, and a conveyance speed of the third conveyance rotary member, wherein the controller is able to set the conveyance speed of the sheet by the second conveyance rotary member to a first conveyance speed, which is the same as a conveyance speed of the sheet by the first conveyance rotary member, and a second conveyance speed which is different from the first conveyance speed, and wherein, when the controller sets the conveyance speed of the sheet by the first conveyance rotary member to the first conveyance speed and sets the conveyance speed of the sheet by the second conveyance rotary member to the second conveyance speed, the controller sets the conveyance speed of the sheet by the third conveyance rotary member to a third conveyance speed which is a speed between the first conveyance speed and the second conveyance speed.

* * * * *